US011442374B2

(12) United States Patent
Taniguchi

(10) Patent No.: US 11,442,374 B2
(45) Date of Patent: Sep. 13, 2022

(54) IMAGE FORMING APPARATUS USING MEASUREMENT IMAGES TO CONTROL SPEED OF PHOTORECEPTORS AND INTERMEDIATE TRANSFER MEMBER

(71) Applicant: CANON KABUSHIKI KAISHA, Tokyo (JP)

(72) Inventor: Koichi Taniguchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/403,285

(22) Filed: Aug. 16, 2021

(65) Prior Publication Data

US 2021/0373451 A1 Dec. 2, 2021

Related U.S. Application Data

(63) Continuation of application No. 16/839,418, filed on Apr. 3, 2020, now Pat. No. 11,126,105.

(30) Foreign Application Priority Data

Apr. 17, 2019 (JP) ..... JP2019-078336

(51) Int. Cl.
*G03G 15/00* (2006.01)
*G03G 15/01* (2006.01)
*G03G 15/16* (2006.01)

(52) U.S. Cl.
CPC ..... *G03G 15/0131* (2013.01); *G03G 15/1605* (2013.01); *G03G 15/5058* (2013.01); *G03G 2215/0161* (2013.01)

(58) Field of Classification Search
CPC ..... G03G 15/5058; G03G 15/5054; G03G 15/5008; G03G 15/505
USPC ..... 399/49, 167, 301
See application file for complete search history.

(56) References Cited

U.S. PATENT DOCUMENTS 8,526,867 B2 9/2013 Cho et al.
10,466,636 B2 11/2019 Kishi et al.
11,126,105 B2 * 9/2021 Taniguchi ..... G03G 15/5058

* cited by examiner

*Primary Examiner* — William J Royer
(74) *Attorney, Agent, or Firm* — Venable LLP

(57) ABSTRACT

An image forming apparatus includes a first sensor configured to measure measurement images on a first photoreceptor, a second sensor configured to measure measurement images on an intermediate transfer member, and a controller. The controller controls a first image forming unit to form first measurement images, wherein the first measurement images are formed along a rotation direction of the first photoreceptor, and controls the first sensor to measure the first measurement images on the first photoreceptor. The controller further controls the first image forming unit and a second image forming unit to form a plurality of measurement images while a rotation speed of the first photoreceptor is being controlled based on a measurement result of the first sensor, wherein the plurality of measurement images are formed along the predetermined direction of the intermediate transfer member.

15 Claims, 14 Drawing Sheets

FIG. 5A
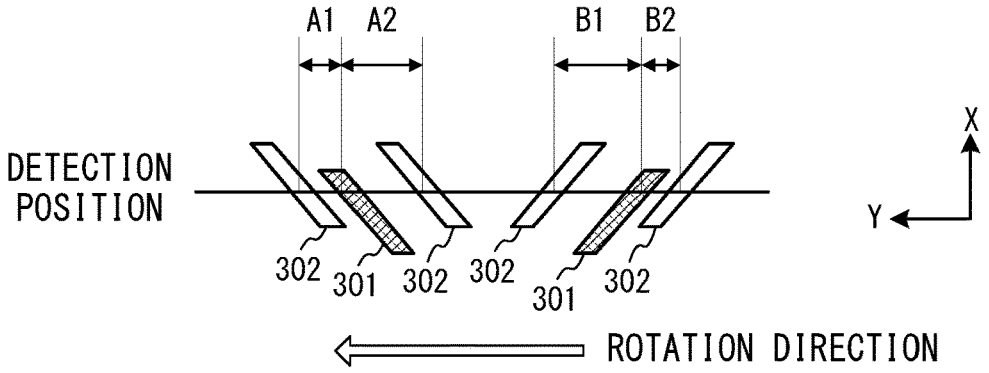
FIG. 5B
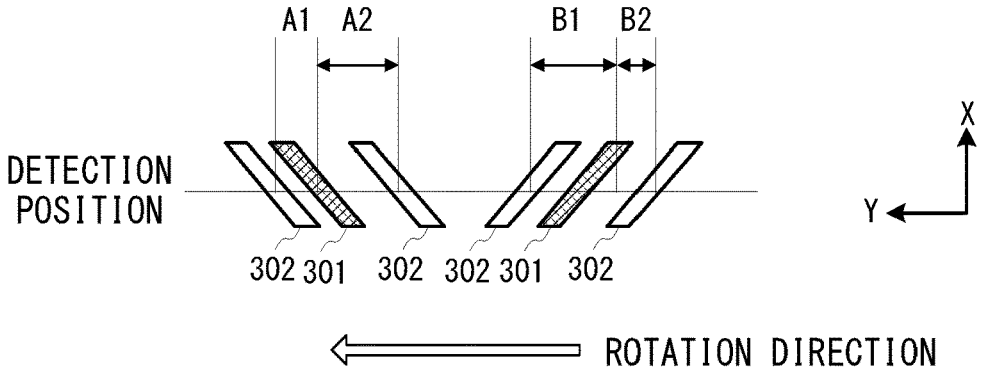
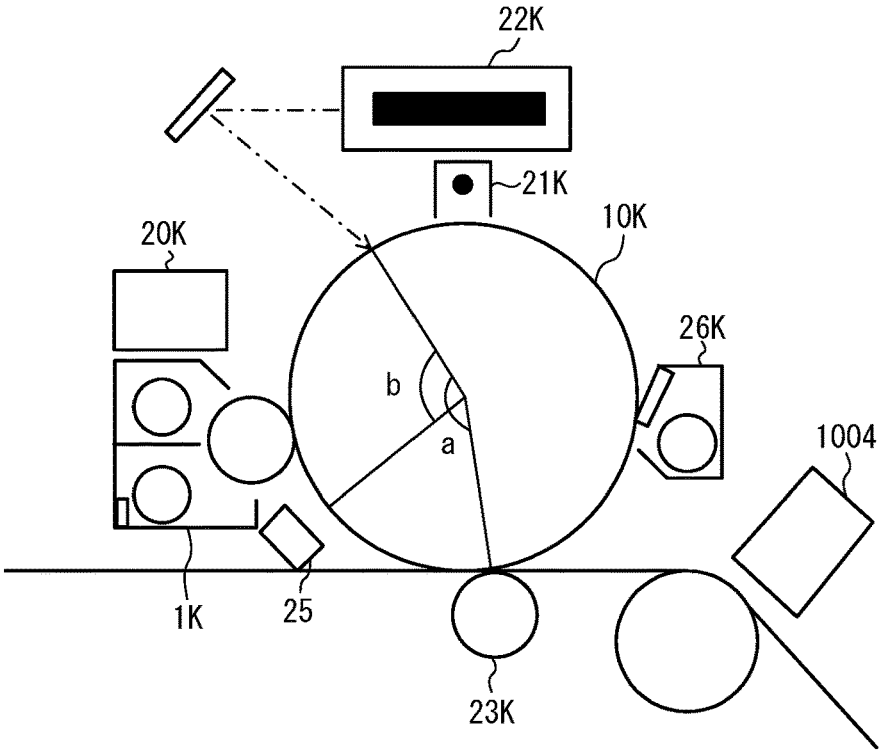
FIG. 6

IMAGE FORMING APPARATUS USING MEASUREMENT IMAGES TO CONTROL SPEED OF PHOTORECEPTORS AND INTERMEDIATE TRANSFER MEMBER

BACKGROUND OF THE INVENTION

Field of the Invention

The present disclosure relates to an image forming apparatus such as a laser printer, a digital multifunction peripheral or the like, which is provided with a scanning optical device for scanning a photoreceptor by deflecting a laser beam emitted from a laser unit.

Description of the Related Art

In an image forming apparatus for forming a color image by an electrophotographic system, image formation of a plurality of colors is performed in parallel by a plurality of image forming parts, thereby speeding up entire processing. The images of different colors formed by each image forming part are sequentially and superimposingly transferred to a recording material. The color image is thus formed on the recording material. Each image forming part has, for example, a photoreceptor, and the image is formed by irradiating (scanning) each photoreceptor with the laser beam from the scanning optical device. The scanning optical device is provided with a laser unit serving as a light source for the laser beam, a deflector for deflecting the laser beam, and optical components such as a lens and a mirror. The deflector is, for example, a rotating polygon mirror, and generates heat as it rotates. Due to an influence of heat generation, deformation or position/posture change of the optical components may be caused. This causes a variation in an irradiation position of the laser beam on the photoreceptor. The variation in the irradiation position of the laser beam on the photoreceptor becomes a variation in the image forming position. In a case where one scanning optical device is provided for each image forming part, a variation amount in the irradiation position of the laser beam varies depending on the photoreceptor of each image forming part. Therefore, the image of each color is inaccurately superimposed on each other and transferred to a recording material, which results in so-called misregistration.

A misregistration correction (hereinafter referred to as "auto registration") is performed for the misregistration, in which an image for detecting the misregistration (detection image) is formed on an intermediate transfer member, and a misregistration amount is detected from the detection image to correct the misregistration. The intermediate transfer member is a transfer member to which the image is sequentially superimposed and transferred from each photoreceptor. The image of each color is transferred from the intermediate transfer member to the recording material at a time. The detection image is formed by periodically and repeatedly forming a patch image of each color having a same shape on the intermediate transfer member. The detection image is read by, for example, an optical sensor. In the auto registration, the detection image on the intermediate transfer member is read by the optical sensor, and the misregistration amount is detected from a reading result. The misregistration amount is detected, for example, by measuring an interval between the patch images for each color forming the detection image. By controlling image writing timing (timing at which irradiation of the photoreceptor with the laser beam is started) on the basis of the misregistration amount, the irradiation position of the laser beam is corrected to correct the misregistration. In this way, the variation in the irradiation position of the laser beam due to the deformation, position/posture change of the optical components is corrected by the auto registration.

The photoreceptor is often formed in a drum shape. The drum-shaped photoreceptor is referred to as a "photosensitive drum". The photosensitive drum rotates around a drum shaft to form the image on a surface. For this reason, unevenness may occur periodically for each rotation of the photosensitive drum. Such unevenness occurring periodically is referred to as "periodic unevenness". The periodic unevenness is a factor which deteriorates image quality of the image to be formed. However, the auto registration cannot cope with the periodic unevenness. U.S. Pat. No. 8,526,867 proposes a method of forming the patch image at regular intervals on the intermediate transfer member, and detecting to correct the periodic unevenness according to the interval.

The intermediate transfer member is often formed in an endless belt shape. The intermediate transfer member is rotationally driven by a predetermined driving roller to transfer the images sequentially transferred from each photosensitive drum to the recording material. Measurement of the interval between the patch images of each color on the intermediate transfer member may not be accurately performed due to variation in a surface speed of the intermediate transfer member caused by disturbances such as eccentricity of the driving roller, unevenness in a thickness of the intermediate transfer member and the like. In particular, in a case where a diameter of the driving roller of the intermediate transfer member is similar to that of the photosensitive drum, the disturbance occurs at a period close to the periodic unevenness of the photosensitive drum desired to be detected. This makes it more difficult to accurately detect the periodic unevenness of the photosensitive drum from the interval between the patch images of each color.

In view of the above problems, it is a main object of the present disclosure to provide an image forming apparatus capable of detecting the periodic unevenness occurring in the photosensitive drum with high accuracy by suppressing an influence of the intermediate transfer member.

SUMMARY OF THE INVENTION

An image forming apparatus according to the present disclosure includes a first image forming unit having a first photoreceptor and configured to form a first image on the first photoreceptor by using a first color toner; a second image forming unit having a second photoreceptor and configured to form a second image on the second photoreceptor by using a second color toner which is different from the first color toner; an intermediate transfer member configured to rotate in a predetermined direction and to which the first image and the second image are transferred; a transfer unit configured to transfer the first image and the second image from the intermediate transfer member to a sheet; a first sensor configured to measure measurement images on the first photoreceptor; a second sensor configured to measure measurement images on the intermediate transfer member; and a controller configured to: control the first image forming unit to form first measurement images, wherein the first measurement images are formed along a rotation direction of the first photoreceptor; control the first sensor to measure the first measurement images on the first photoreceptor; control the first image forming unit and the second image forming unit to form a plurality of measurement images while a rotation speed of the first photoreceptor is being controlled based on a measurement result of the first sensor, wherein the plurality of measurement images are formed along the predetermined direction of the intermediate transfer member, wherein the plurality of measurement images include reference measurement images formed by using the first color toner and second measurement images formed by using the second color toner, wherein positions at which the second measurement images are transferred on the intermediate transfer member are different from positions at which the reference measurement images are transferred on the intermediate transfer member in a direction orthogonal to the predetermined direction; control the second sensor to measure the plurality of measurement images; and control a rotation speed of the second photoreceptor based on a measurement result of the second sensor.

Further features of the present invention will become apparent from the following description of exemplary embodiments (with reference to the attached drawings).

BRIEF DESCRIPTION OF THE DRAWINGS

FIG. 5A and FIG. 5B are diagrams each explaining how to derive positional relation.

FIG. 6 is a diagram explaining a drum upper sensor.

DESCRIPTION OF THE EMBODIMENTS

Embodiments of the present disclosure will be described with reference to the drawings.

Configuration of Image Forming Apparatus

Figure 1:
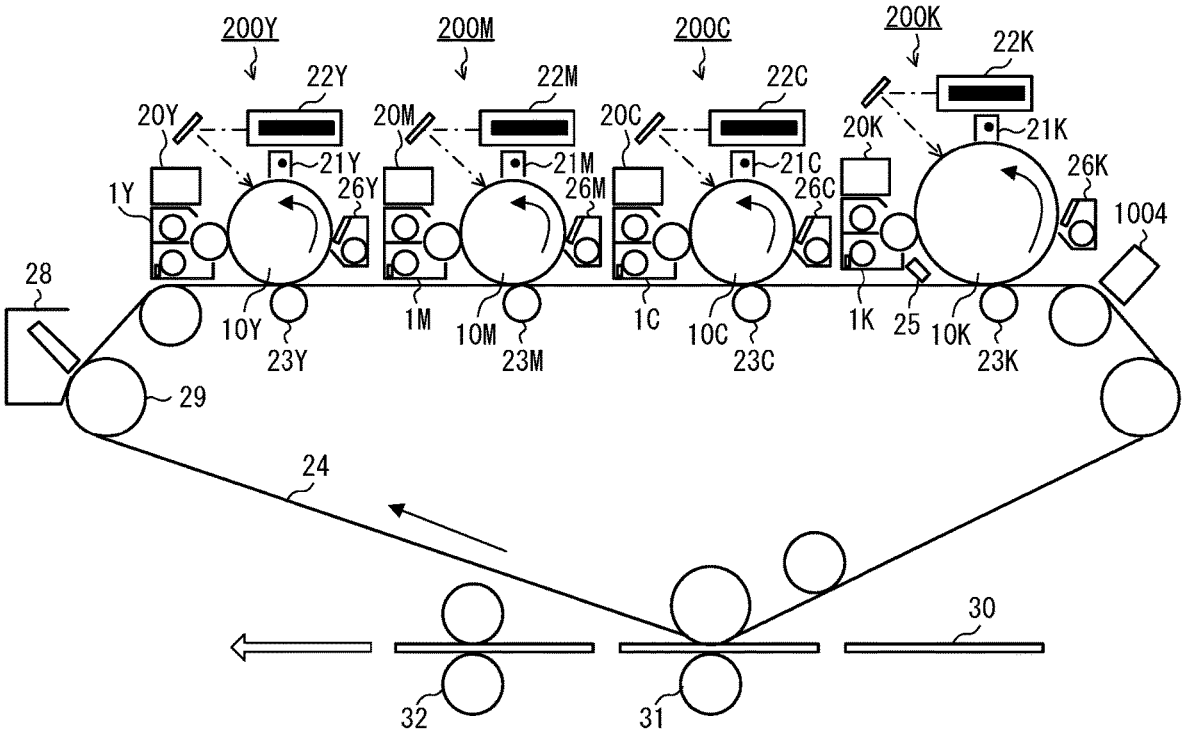
FIG. 1 is a diagram explaining a configuration of an image forming apparatus.

FIG. 1 is a diagram explaining a configuration of an image forming apparatus of the present embodiment. The image forming apparatus of the present embodiment is an electrophotographic system and can form the color image on a recording material 30 such as a sheet. The image forming apparatus performs image formation on the recording material 30 by employing an intermediate transfer tandem system. That is, the image forming apparatus includes four image forming parts 200Y, 200M, 200C, and 200K for respectively forming images of four different colors. The image is transferred from each of the image forming parts 200Y, 200M, 200C, and 200K to an intermediate transfer member 24. Thereafter, the image is transferred from the intermediate transfer member 24 to the recording material 30. The image forming part 200Y forms an image of yellow (Y). The image forming part 200M forms an image of magenta (M). The image forming part 200C forms an image of cyan (C). The image forming part 200K forms an image of black (K).

Each of the image forming parts 200Y, 200M, 200C, and 200K includes photosensitive drums 10Y, 10M, 10C, and 10K as photoreceptors on which the image is formed, respectively. The photosensitive drums 10Y, 10M, 10C, and 10K are drum-shaped. The photosensitive drums 10Y, 10M and 10C are the same in size, and the photosensitive drum 10K has a larger drum diameter than the other photosensitive drums 10Y, 10M and 10C. This is to prevent the photosensitive drum 10K from being consumed earlier than the other photosensitive drums 10Y, 10M, and 10C as only the image forming part 200K operates when forming a monochrome image.

Each of the image forming parts 200Y, 200M, 200C, 200K includes chargers 21Y, 21M, 21C, and 21K, exposure devices 22Y, 22M, 22C, and 22K, developing devices 1Y, 1M, 1C, and 1K, and cleaners 26Y, 26M, 26C, and 26K, respectively. Each of the image forming parts 200Y, 200M, 200C, and 200K includes primary transfer rollers 23Y, 23M, 23C, and 23K at positions sandwiching the intermediate transfer member 24, respectively. In the following description, Y, M, C, and K are added to the end of symbols when to distinguish each color, but Y, M, C, and K are omitted when not to distinguish the colors.

The photosensitive drum 10 is an image carrier and is provided so as to be rotatable in a counterclockwise direction in the figure around a drum shaft. The charger 21 uniformly charges a surface (side surface) of the rotating photosensitive drum 10. The exposure device 22 is a scanning optical device for irradiating the surface of the charged photosensitive drum 10 with a laser beam modulated according to image data of a corresponding color. The photosensitive drum 10 is irradiated with the laser beam to form an electrostatic latent image corresponding to the image data. The developing device 1 develops the electrostatic latent image with developer (in the present embodiment, toner) of a corresponding color to form a toner image as a visualized image on the photosensitive drum 10.

The developing device 1 of the present embodiment develops the electrostatic latent image using two-component developer containing nonmagnetic toner and a carrier with low magnetization and high resistance. The nonmagnetic toner is formed by using an appropriate amount of a binder resin such as a styrene resin and a polyester resin, colorant such as carbon black dye and pigment, a release agent such as wax, a charge control agent, and the like. Such nonmagnetic toner can be produced by a conventional method such as a pulverization method and a polymerization method. The toner is charged by being frictionally charged with the carrier in the developing device 1. When a developing bias voltage is applied, the charged toner adheres to the electrostatic latent image on the photosensitive drum 10 due to a potential difference from the photosensitive drum 10, thereby visualizing the electrostatic latent image. In this embodiment, a negatively charged toner is used. It should be noted that the developing device 1 includes a toner supply tank 20 (20Y, 20M, 20C, 20K) for supplying the toner consumed through the image formation.

The developing device 1Y forms a yellow toner image on the photosensitive drum 10Y with yellow toner. The developing device 1M forms a magenta toner image on the photosensitive drum 10M with magenta toner. The developing device 1C forms a cyan toner image on the photosensitive drum 10C with cyan toner. The developing device 1K forms a black toner image on the photosensitive drum 10K by black toner.

The toner image on the photosensitive drum 10 is transferred to the intermediate transfer member 24 by the primary transfer roller 23. The toner remaining on the photosensitive drum 10 after the transfer is removed by the cleaner 26. The intermediate transfer member 24 is an endless belt-shaped transfer member, and is rotationally driven clockwise in the figure by a drive roller 29. The toner images are sequentially and superimposingly transferred to the intermediate transfer member 24 from each of the photosensitive drums 10Y, 10M, 10C, and 10K according to a rotation speed of the intermediate transfer member 24. A full color toner image thus is formed on the intermediate transfer member 24.

The image forming apparatus includes a secondary transfer roller 31 for transferring the toner image formed on the intermediate transfer member 24 to the recording material 30. As the intermediate transfer member 24 rotates, the toner image on the intermediate transfer member 24 is conveyed to the secondary transfer roller 31 side. The secondary transfer roller 31 conveys the recording material 30 while holding the recording material 30 between the secondary transfer roller 31 and the intermediate transfer member 24. During the conveyance, the secondary transfer roller 31 transfers the toner image to the recording material 30. The toner remaining on the intermediate transfer member 24 after the transfer is removed by a cleaner 28 provided near the drive roller 29. It should be noted that a surface to which the toner image on the intermediate transfer member 24 is transferred has an elastic layer to correspond to quality of material of the recording material 30 on which the image is formed. For example, even in the case of the recording material 30 having ruggedness, a transfer property to a concave portion is ensured by being transferred from the elastic layer.

The recording material 30 having the toner image transferred thereto is conveyed to a fixing device 32 by the secondary transfer roller 31. The fixing device 32 fixes the toner image on the recording material 30. The fixing device 32 fixes the toner image on the recording material, for example, by heating and melting the toner and pressurizing it. As above, the image is formed on the recording material 30.

A drum upper sensor 25 is provided near the photosensitive drum 10K. The drum upper sensor 25 can read a measurement image, described later, formed on the surface of the photosensitive drum 10K. An intermediate transfer member upper sensor 1004 is provided near the intermediate transfer member 24 and at a position where the toner image transferred from each of the image forming portions Y, M, C, and K can be read. The intermediate transfer member upper sensor 1004 can read a detection image, described later, and the measurement image formed on the intermediate transfer member 24.

Developing Processing

Figure 2:
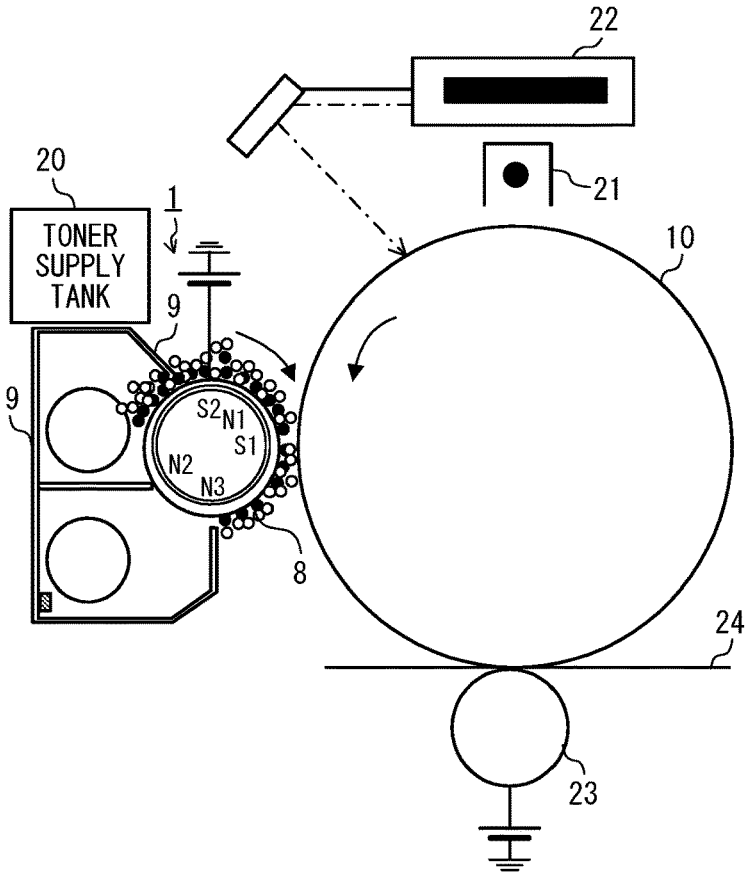
FIG. 2 is a diagram explaining developing processing by a developing device.
Figure 3:
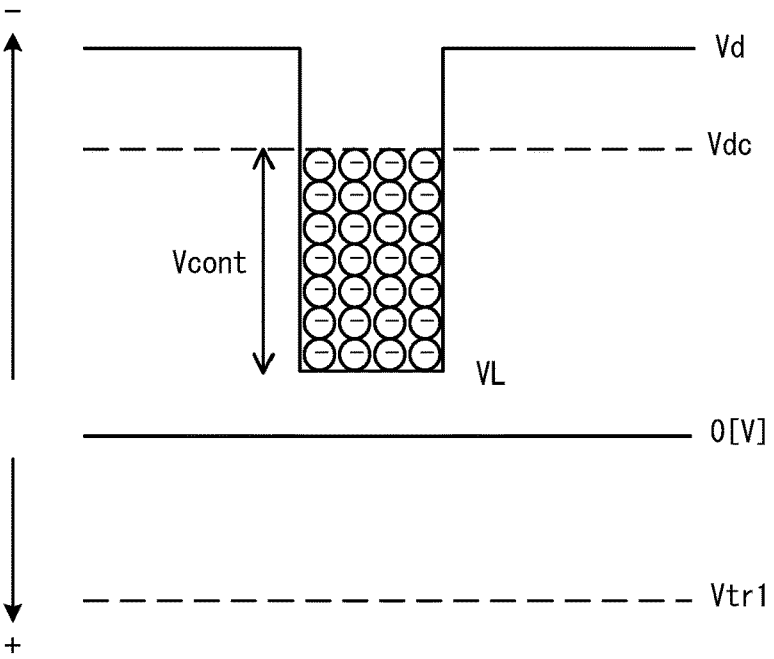
FIG. 3 is a diagram explaining the developing processing by the developing device.

FIG. 2 and FIG. 3 are diagrams each explaining developing processing performed by the developing device 1. The developing device 1 has a storage part 9 for storing the toner and a developer carrier 8 for conveying the toner from the storage part 9 to the vicinity of the photosensitive drum 10. When the amount of toner stored in the storage part 9 becomes a predetermined amount or less, the toner is supplied from the toner supply tank 20.

The surface of the photosensitive drum 10 is charged to negative potential Vd by the charger 21. Potential (exposure portion potential) VL of the photosensitive drum 10 where the electrostatic latent image is formed is discharged from the potential Vd toward 0 V. The potential Vd is, for example, −700 V, and the exposure portion potential VL is, for example, −200 V.

The developing device 1 conveys the developer containing the negatively charged toner near the photosensitive drum 10 by the developer carrier 8. Developing bias potential Vdc which is applied to the developer carrier 8 during development is potential between the potential Vd and the exposure portion potential VL, for example, −550 V. The negatively charged toner on the developer carrier 8 flies to a portion of the exposure portion potential VL relatively closer to positive potential than the potential Vd on the surface of the photosensitive drum 10 and the developing bias potential Vdc by the negative developing bias potential Vdc. As a result, an amount of toner corresponding to developing latent image potential Vcont, which is a difference between the developing bias potential Vdc and the exposure portion potential VL, is adhered to the photosensitive drum 10. Density of the toner image is determined according to the amount of the toner adhering to the photosensitive drum 10. Therefore, an image density can be adjusted by adjusting the developing latent image potential Vcont. The negative polarity toner which flies to the photosensitive drum 10 is transferred to the intermediate transfer member 24 by a pressure and an electric field between the primary transfer roller 23 and the intermediate transfer member 24. At this time, primary transfer bias potential Vtr1 having the polarity opposite to that of the toner is applied to the primary transfer roller 23. For example, the primary transfer bias potential Vtr1 is +1500 V.

Image Forming Processing

A case of continuously performing image forming processing on two sheets of recording materials 30 will be described. The image forming apparatus performs pre-rotation processing, image forming processing, inter-sheet processing, and post-rotation processing during the image forming processing.

The pre-rotation processing is processing for bringing a driving part of the photosensitive drum 10, a high voltage member such as the charger 21, and the like into a stable operation state for performing the image formation. In the pre-rotation processing, the photosensitive drum 10 and the intermediate transfer member 24 are driven. Since inertia of the photosensitive drum 10 and the intermediate transfer member 24 is large, it takes a predetermined time, for example, 500 milliseconds, until the photosensitive drum 10 and the intermediate transfer member 24 reach a target rotation speed (target speed) and stably operate at a constant speed after starting the driving of the photosensitive drum 10 and the intermediate transfer member 24. After the photosensitive drum 10 and the intermediate transfer member 24 are stably operated at a constant speed, charging bias is applied to the charger 21. The primary transfer bias potential Vtr1 is applied on the basis of timing at which the charged portion on the photosensitive drum 10 passes through the transfer position by the primary transfer roller 23. The driving part of the developer carrier 8 and the developing bias potential Vdc may be at a predetermined rotation speed and predetermined potential before the electrostatic latent image formed on the photosensitive drum 10 approaches the developer carrier 8. However, to prevent deterioration of the toner, it is desirable that the driving part of the developer carrier 8 and the developing bias potential Vdc reach a predetermined rotation speed and predetermined potential at timing as late as possible.

The image forming processing is processing for forming the toner image on the photosensitive drum 10 and transferring the formed image to the intermediate transfer member 24. In the image forming processing, the surface of the charged photosensitive drum 10 is exposed to the laser beam from the exposure device 22 at timing determined by a color registration adjustment mode, described later, to form the electrostatic latent image. The developing device 1 visualizes the electrostatic latent image with the toner. The primary transfer roller 23 transfers the toner image formed on the photosensitive drum 10 to the intermediate transfer member 24.

The inter-sheet processing is processing for operating each driving part and the high voltage member without performing the image forming processing in a minute gap generated between a first recording material and a second recording material. In the inter-sheet processing, exposure by the exposure device 22 is not performed, but each driving part and the high voltage member maintain a state in which the image forming processing is possible. The post-rotation processing means processing for stopping each driving part and the high voltage member. In the post-rotation processing, the rotation of the photosensitive drum 10 and the intermediate transfer member 24 is stopped after the exposure device 22, the charger 21, the driving part of the developer carrier 8, the developing bias potential Vdc, the primary transfer bias potential Vtr1, and the charging bias are stopped in this order.

Color Registration Adjustment Mode

The color registration adjustment mode is an operation mode for performing the auto registration, and is set when correcting the image writing position (irradiation position of the laser beam) on the photosensitive drum 10 of each color. To perform the auto registration, in the color registration adjustment mode, a detection image for detecting the misregistration is formed on the intermediate transfer member 24. The detection image for detecting the misregistration is read by the intermediate transfer member upper sensor 1004. The position of the detection image on the intermediate transfer member 24 is detected on the basis of a reading result of the detection image for detecting the misregistration. The image writing position on the photosensitive drum 10 is corrected on the basis of a detection result.

The color registration adjustment mode is performed by an instruction from a user or at predetermined timing, such as when starting up the image forming apparatus and after the image formation on a predetermined number of sheets. In the color registration adjustment mode, deviation of the image writing position due to a manufacturing variation of the image forming apparatus and aging of the image writing position due to temperature rise and the like in the apparatus are corrected.

Figure 4:
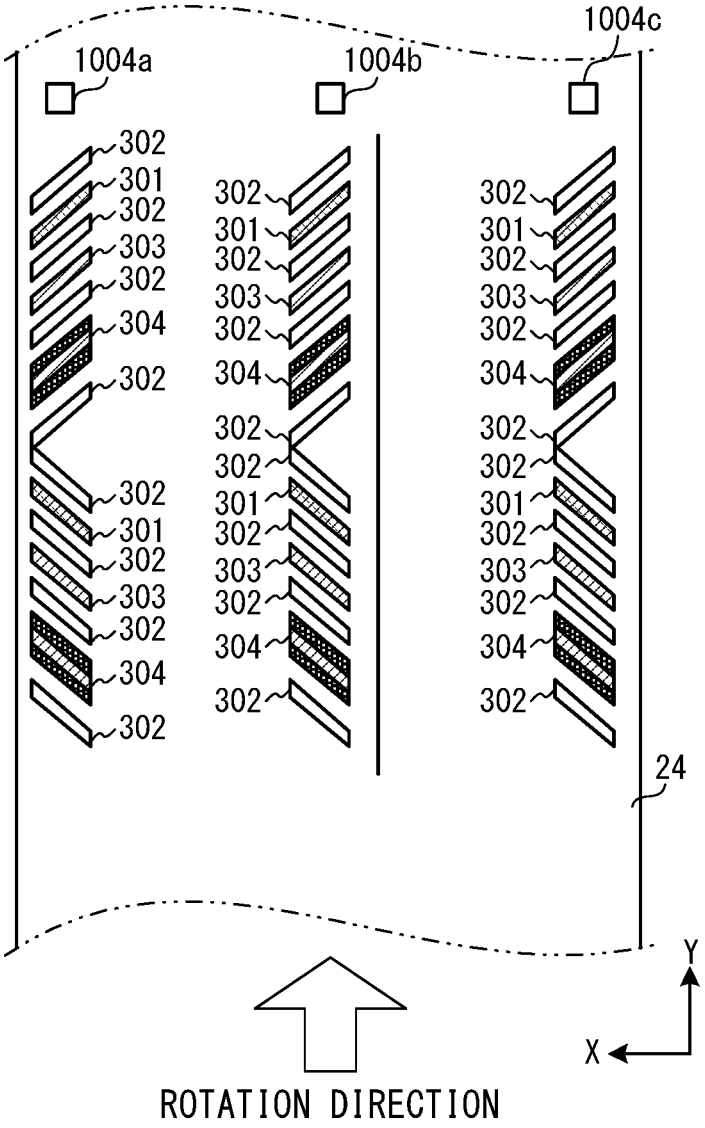
FIG. 4 is a diagram showing an example of a detection image.

When the color registration adjustment mode is started, the intermediate transfer member 24 is rotationally driven and the image formation of the detection image is started. FIG. 4 is a diagram showing an example of the detection image to be formed on the intermediate transfer member 24. A plurality of intermediate transfer member upper sensors 1004 for detecting the detection image are provided in a direction orthogonal to a rotation direction of the intermediate transfer member 24 (X-axis direction). In the present embodiment, three sensors, that is, an intermediate transfer member upper sensor 1004*a*, an intermediate transfer member upper sensor 1004*b*, and an intermediate transfer member upper sensor 1004*c* are arranged as the intermediate transfer member upper sensor 1004. The detection image is an image in which rows of images of each color arranged in the rotation direction (Y-axis direction) of the intermediate transfer member 24 are arranged in three rows according to the detection positions of the intermediate transfer member upper sensors 1004*a*, 1004*b*, and 1004*c*.

In the detection image, a magenta patch image 302 as a reference color is arranged between a yellow patch image 301, a cyan patch image 303, and a black patch image 304 to form one row. It should be noted that the intermediate transfer member upper sensor 1004 is an optical sensor which reads the detection image by reading diffused reflection light. It is difficult for such an intermediate transfer member upper sensor 1004 to directly read the black patch image 304. Because of that, the black patch image 304 is formed such that the magenta image as the reference color is overlapped with a part of the black image.

The position of the detection image on the intermediate transfer member 24 is detected on the basis of the reading result of the detection image by the intermediate transfer member upper sensor 1004. Relative positional relation between the patch images 301 to 304 of each color is derived on the basis of a time during which the detection image passes through the detection position of the intermediate transfer member upper sensor 1004 by the rotation of the intermediate transfer member 24.

For example, the positional relation between the yellow patch image 301 and the magenta patch image 302 is derived as follows. FIG. 5A and FIG. 5B are diagrams each explaining how to derive the positional relation. FIG. 5A illustrates a case where the yellow patch image 301 is deviated in the X-axis direction from the magenta patch image 302 as the reference color. FIG. 5B illustrates a case where the yellow patch image 301 is deviated in the Y-axis direction from the magenta patch image 302 as the reference color. In the present embodiment, the position of the patch image of each color is a center (center of gravity) when the patch image passes through the detection position of the intermediate transfer member upper sensor 1004. It should be noted that the position of the patch image may be a point at which the patch image enters the detection position of the intermediate transfer member upper sensor 1004 or a point at which the patch image passes through the detection position of the intermediate transfer member upper sensor 1004.

The yellow patch image 301 is sandwiched between the magenta patch images 302, and distances between the centers of gravity of the patch images 301 and 302 are A1, A2, B1, and B2. When no misregistration is caused (no deviation is caused in the positional relation), A1=A2=B1=B2. A deviation amount ΔH in the X-axis direction of the yellow patch image 301 in the state shown in FIG. 5A is expressed by the following equation.

$$\Delta H=\{(B2-B1)/2-(A2-A1)/2\}/2$$

Similarly, a deviation amount ΔV in the Y-axis direction of the yellow patch image 301 in the state shown in FIG. 5B is expressed by the following equation.

$$\Delta V=\{(B2-B1)/2+(A2-A1)/2\}/2$$

In many cases, actual misregistration occurs simultaneously in both the X-axis direction and the Y-axis direction. Even in that case, since the above two equations are independently established, the positional relation (misregistration) of the yellow patch image 301 with respect to the reference color (magenta patch image 302) can accurately be derived. The misregistration is represented by the deviation amount ΔH in the X-axis direction and the deviation amount ΔV in the Y-axis direction.

As described above, the detection image is a combination of patch images 301 to 304 of each color. In the color registration adjustment mode, usually, a plurality of detection images shown in FIG. 4 are formed. In this embodiment, ten detection images are formed. This is because the detection image is influenced by various disturbances, resulting in a minute variation in the image forming position. By detecting the image forming position of each color from the reading results of a plurality of detection images and using an average value thereof, the influence of the variation in the image forming position is suppressed.

In the color registration adjustment mode, the positional relation (misregistration) between the patch images 301, 303, and 304 of each color with respect to the patch image 302 of the reference color is derived from the ten detection images, and the average value thereof is derived. To correct the average value, a color registration adjustment value of each color is derived as a correction value. In the exposure device 22, the exposure timing of the laser beam is determined on the basis of the color registration adjustment value of the corresponding color. When the exposure timing of the laser beam is adjusted, the auto registration is performed so that the image writing position (irradiation position of the laser beam) is adjusted. Accordingly, the position of the image (toner image) on the photosensitive drum 10 is adjusted, the image (toner image) is transferred to the intermediate transfer member 24, and the misregistration of the image (toner image) of each color is corrected.

In the present embodiment, three intermediate transfer member upper sensors 1004 are provided. This is to detect and correct an inclination or a bend of the irradiation position due to difference in timing at which the intermediate transfer member upper sensors 1004*a*, 1004*b*, and 1004*c* detect the detection image.

Drum Upper Sensor

FIG. 6 is a diagram explaining a drum upper sensor 25. The drum upper sensor 25 reads the measurement image for measuring the periodic unevenness which occurs for each rotation period of the photosensitive drum 10K formed on the photosensitive drum 10K. The drum upper sensor 25 is effective in a case where the intermediate transfer member 24 has the elastic layer. This is because the intermediate transfer member upper sensor 1004 cannot read the black patch image 304 in a case where the intermediate transfer member 24 has the elastic layer.

In general, many of the drum upper sensors 25 are expensive so that it is desirable to limit the number of sensors to be used. Therefore, in the present embodiment, the drum upper sensor 25 is provided only on the black photosensitive drum 10K. However, for the patch image on the intermediate transfer member 24 with the color difficult to be detected, the patch image on the photosensitive drum 10 is detected by the drum upper sensor 25.

Drum HP Sensor

Figure 7:
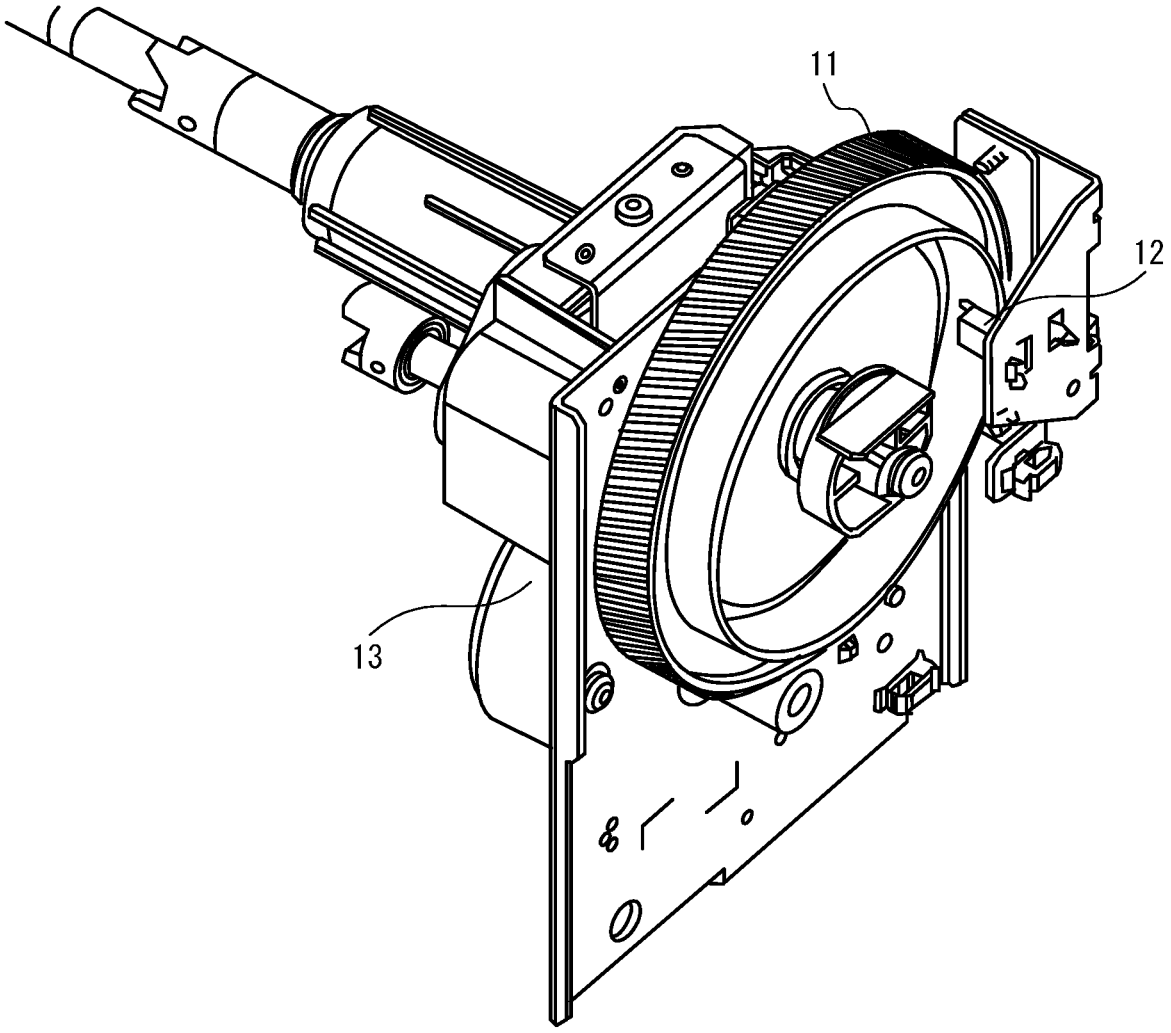
FIG. 7 is a diagram explaining a drum HP sensor.

In the present embodiment, a drum HP sensor for detecting a phase of one rotation of the photosensitive drum 10 is provided to obtain a reference position which is detection reference of the periodic unevenness which periodically occurs for every rotation of the photosensitive drum 10. FIG. 7 is a diagram explaining the drum HP sensor. A drum HP sensor 12 may be configured to accurately detect one rotation period of the photosensitive drum 10. The drum HP sensor 12 of the present embodiment is provided in a driving system for driving the photosensitive drum 10. The driving system of the photosensitive drum 10 includes a drum drive motor 13 serving as a driving source and a gear 11 for transmitting driving force which is output from the drum drive motor 13 to the photosensitive drum 10. The drum HP sensor 12 is provided on a rear surface of the gear 11 which rotationally drives the photosensitive drum 10. The drum HP sensor 12 is configured to detect the one rotation period of the photosensitive drum 10 by, for example, detecting a flag provided at a predetermined position of the gear 11. One drum HP sensor 12 is provided for each of the driving systems of the photosensitive drums 10Y, 10M, 10C, and 10K.

It should be noted that the reference position can be obtained without using the drum HP sensor 12. For example, if the detection result of the periodic unevenness and the position on the photosensitive drum 10 where the periodic unevenness is detected can be specified, the reference position of the periodic unevenness is obtained. In particular, if an absolute encoder is used, a position on the photosensitive drum 10 with respect to one rotation can always be specified, so that correlation with the detected periodic unevenness can be specified. Further, if an encoder is used to control the rotation speed of the photosensitive drum 10, it is possible to use a predetermined position of the encoder as the reference position and to correlate the reference position with the periodic unevenness. However, in this case, if the photosensitive drum 10 is rotated in a state in which no encoder signal can be detected, for example, in a power-off state, it becomes necessary to perform the correlation again when the power is turned on.

Correction of Periodic Unevenness of Photosensitive Drum

Figure 8:
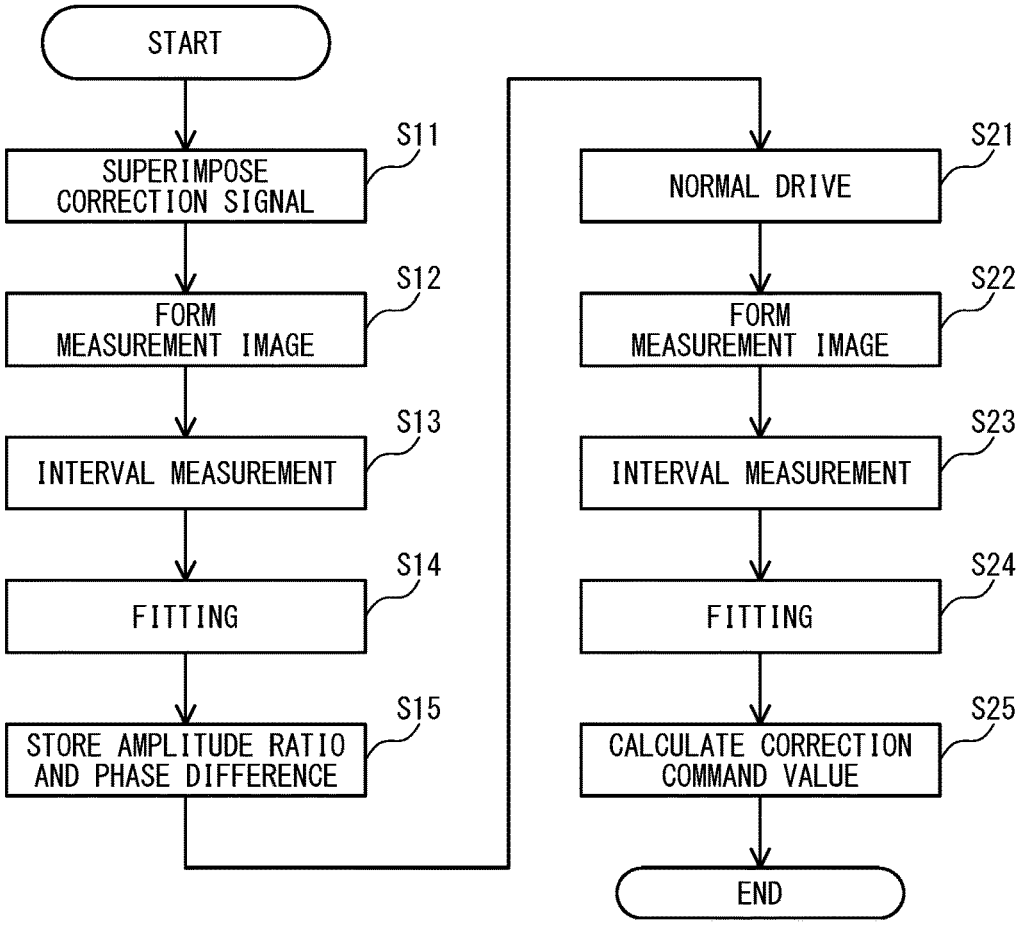
FIG. 8 is a flowchart showing correction processing of periodic unevenness.

Correction processing of the periodic unevenness of the photosensitive drum 10 will be described. Here, correction of the periodic unevenness to the black photosensitive drum 10K on which the drum upper sensor 25 is provided will be described. FIG. 8 is a flowchart showing the correction processing of the periodic unevenness of the photosensitive drum 10K. The correction processing is roughly divided into two phases. In a first phase, a response of the photosensitive drum 10K as the drum drive control system is correlated by the reference position of one rotation of the photosensitive drum 10K and a correction signal. In a second phase, the periodic unevenness of the photosensitive drum 10K is corrected according to an actual measurement result of the measurement image. The second phase is executed after executing the first phase. The processing is performed by a main control system (described later).

The processing of the first phase will be described.

Simultaneously with detection of the reference position by the drum HP sensor 12K, the correction signal of the rotation speed of the photosensitive drum 10K having an amplitude 10 times as much as an assumed amount of the periodic unevenness of the photosensitive drum 10K to be corrected (ten-fold correction signal) is superimposed on a speed command value indicating the rotation speed of the photosensitive drum 10K (Step S11). Since the periodic unevenness of the photosensitive drum 10K is assumed to be approximately 0.1% with respect to the rotation speed of the photosensitive drum 10K, the ten-fold correction signal becomes approximately 1% of the target speed. The correction signal is a primary sine wave and is represented by A sin θ ($\theta=2\pi t/T$). In a case where t=0, the drum HP sensor 12K detects the reference position. $2\pi/T$ is the one rotation period of the photosensitive drum 10K.

Figure 9:
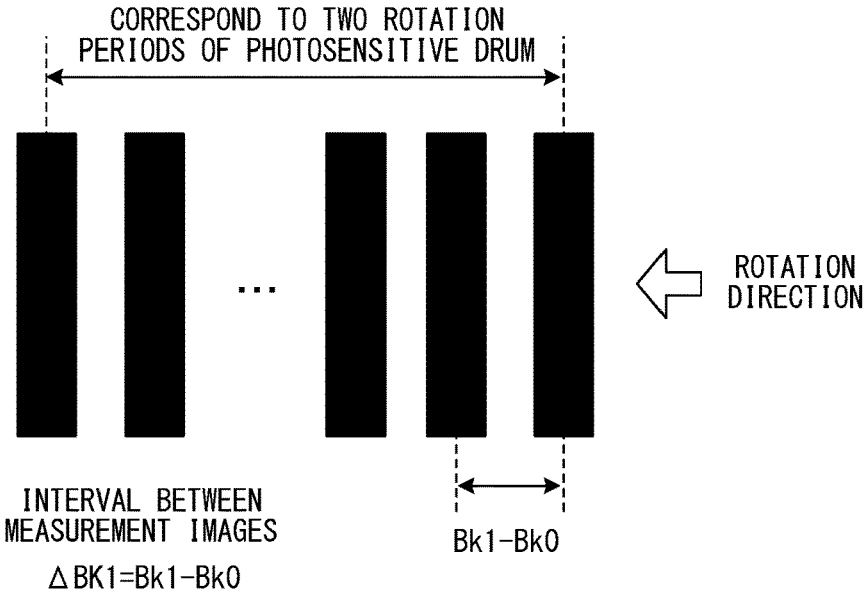
FIG. 9 is a diagram showing an example of a measurement image.

The measurement image for measuring the one rotation period of the photosensitive drum 10K is formed on the photosensitive drum 10K (Step S12). In the present embodiment, in the measurement image, the patch image having a predetermined width is formed at predetermined intervals in the rotation direction of the photosensitive drum 10K in a length corresponding to two rotations of the photosensitive drum 10K. In a case where a circumferential length of the photosensitive drum 10K is 264 mm, the length of the measurement image is 528 mm. FIG. 9 is a diagram showing an example of the measurement image. Unlike the detection image formed in the color registration adjustment mode, the measurement image consists of a plurality of black patch images formed at 1 mm intervals in the rotation direction of the photosensitive drum 10K. Each patch image is a rectangle whose long side is orthogonal to the rotation direction of the photosensitive drum 10K. In the present embodiment, a short side (width direction) of the rectangle is 1 mm.

The interval between the black patch images on the photosensitive drum 10K is measured on the basis of the reading result of the measurement image read from the photosensitive drum 10K by the drum upper sensor 25 (Step S13). A positional deviation waveform on the surface (detection surface) of the photosensitive drum 10K is calculated with respect to the interval between the black patch images on the photosensitive drum 10K, and fitting of A' $\sin(\theta+\alpha+\pi/2)$ to a primary trigonometric function is performed by a least squares method (Step S14). The details of the fitting will be described later. An amplitude ratio A'/A and a phase difference $\alpha$ are stored in a predetermined memory on the basis of a result of the fitting (Step S15).

As described above, the processing of the first phase is performed. Each processing of the first phase will be described in detail. It is a purpose of the first phase to correlate the response as the drum drive control system according to the reference position of one rotation of the photosensitive drum 10K and the correction signal, and the amplitude ratio and the phase difference obtained in the processing of the Step S15 correspond to this.

Figure 10:
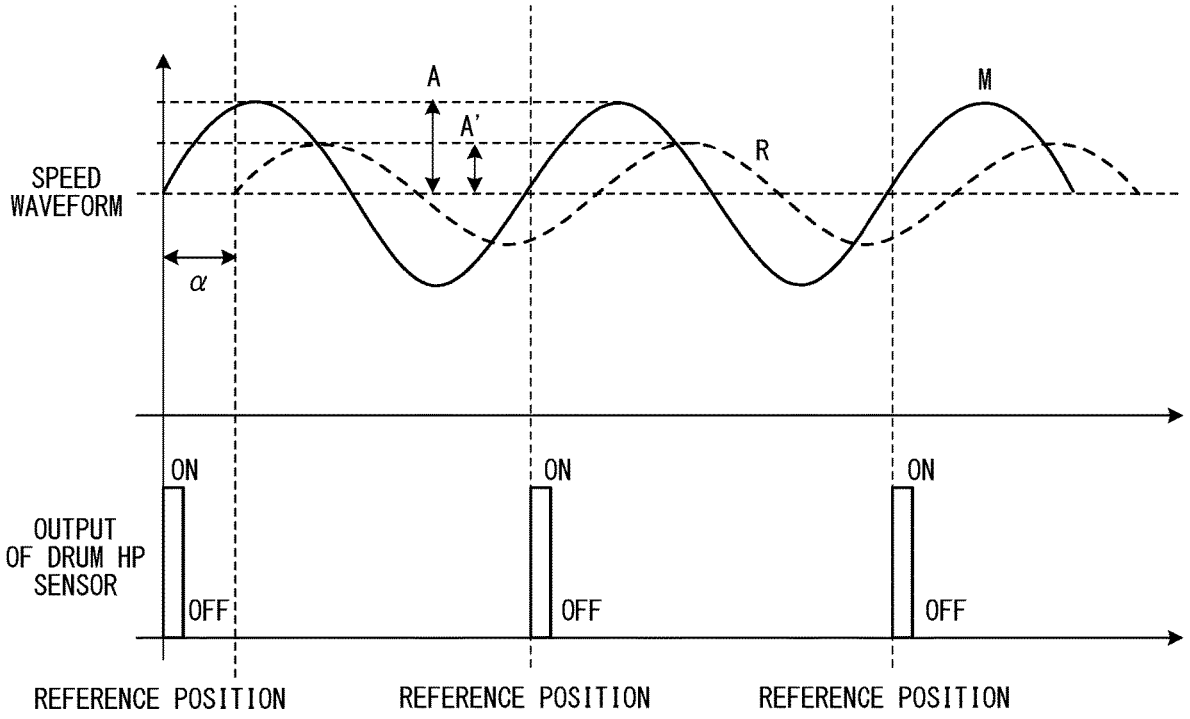
FIG. 10 is a diagram explaining processing of a first phase.

FIG. 10 is a diagram explaining the processing of the first phase. In the first phase, a correction signal M having the amplitude 10 times as much as the assumed amount is superimposed at the reference position of the photosensitive drum 10K, and a response waveform (positional deviation waveform) R, which is the response of the drum drive control system, is obtained. The amplitude of the correction signal M is A, the amplitude of the misregistration waveform is A', and the phase difference is $\alpha$. The amplitude ratio A'/A and the phase difference $\alpha$ are determined by two factors.

A first factor is the response as the drum drive control system of the photosensitive drum 10K to be controlled when the correction signal is input. In particular, a gain and the phase difference in a frequency response must be obtained. In general, the frequency response often expresses a response as a Bode diagram when a frequency transition is performed. However, in the present embodiment, since the frequency is the one rotation period of the photosensitive drum 10K, it is not necessary to perform the transition of the frequency. Therefore, in the present embodiment, the gain and the phase difference of the one rotation period are obtained. The reason why the amplitude of the correction signal is set to 10 times in the processing of the Step S11 is to accurately measure the gain and the phase difference by reflecting the response of the drum drive control system more remarkably. Further, if the drum drive control system is accurately identified, it is possible to obtain the amplitude and the phase difference from the transfer function equation.

A second factor is that the amplitude and the phase of the periodic unevenness of the photosensitive drum 10K obtained from the detection result of the measurement image by the intermediate transfer member upper sensor 1004 are different from the amplitude and the phase obtained from the detection result of the measurement image by the drum upper sensor 25. It means that the second factor is a geometric response of the drum drive control system. Relation between the amplitude and the phase differs depending on the respective positions of the exposure position on the photosensitive drum 10K where the measurement image is written, the position where the measurement image is transferred to the intermediate transfer member 24, and the detection position by the drum upper sensor 25. Geometrically, they are represented by the following equation.

When a surface speed Dv of the photosensitive drum 10K is expressed by $Dv=Vdr+R\sin(\omega)$, a speed Tv at the transfer position of the intermediate transfer member 24 and a speed Sv at the detection position of the drum upper sensor 25 are expressed by the following equations.

$$Tv=Dv(\omega)-Dv(\omega+a)$$

$$Sv=Dv(\omega)-DV(\omega+b)$$

a denotes an angle between the exposure position and the transfer position shown in FIG. 6. b denotes an angle between the exposure position and the detection position shown in FIG. 6. The surface speed Dv ($\omega$) of the photosensitive drum 10K is calculated from these equations.

From the two factors as above, the amplitude ratio A'/A and the phase difference $\alpha$ are finally derived. The two factors can be calculated in advance by the above equation. Thus, by calculating the amplitude ratio A'/A and the phase difference $\alpha$ in advance, the processing of the first phase becomes unnecessary. However, depending on the accuracy of the identification of the drum drive control system, the individual variation, accuracy of the geometric positional relation, and the like, there is a possibility that an error between a theoretical value and an actual value occurs in the amplitude ratio A'/A. If the error is too large to be ignored, it is preferable to directly confirm the response of the target drum drive control system by the processing of the first phase.

The processing of the second phase will be described.

The photosensitive drum 10K is rotationally driven at a specified target speed according to a normal speed command value on which no correction signal is superimposed (Step S21). The measurement image is formed on the photosensitive drum 10K (Step S22). The interval between the black patch images on the photosensitive drum 10K is measured on the basis of the reading result of the measurement image read from the photosensitive drum 10K by the drum upper sensor 25 (Step S23). The positional deviation waveform on the surface (detection surface) of the photosensitive drum 10K is calculated with respect to the measured interval between the patch images, and the fitting of B $\sin(\theta+\beta+\pi/2)$ to the primary trigonometric function is performed by the least squares method (Step S24). The command value for correcting the periodic unevenness of the photosensitive drum 10K is calculated by the following equation on the basis of the result of the fitting (Step S25).

When the correction equation is X $\sin(\theta+\omega)$, $$X=(A\times B)/A'$$

$$\omega=\beta-\alpha$$

Through the above processing, a correction term for correcting the periodic unevenness of the photosensitive drum 10K is determined. By superimposing the command value of the sine wave calculated in the processing of the Step S25 on the speed command value for controlling the rotation speed of the photosensitive drum 10K, the periodic unevenness is corrected. In a case where the speed command value after the correction is V and the speed command value before the correction is Vbk, the speed command value V is expressed by the following equation.

$$V=Vbk+X\sin(\theta+\omega)$$

Drive Control of Photosensitive Drum with No Drum Upper Sensor

To correct the periodic unevenness of all the photosensitive drums 10, it is necessary to correct the periodic unevenness of the photosensitive drums 10 with no drum upper sensor 25 as well. As shown in FIG. 1, in the present embodiment, only the photosensitive drum 10K used for the black image formation is provided with the drum upper sensor 25, and the photosensitive drums 10Y, 10M, and 10C used for chromatic image formation are not provided with the drum upper sensor 25. Here, correction of the periodic unevenness of the photosensitive drum 10Y will be described. The periodic unevenness of the photosensitive drums 10M and 10C can be corrected by the same processing.

Figure 11:
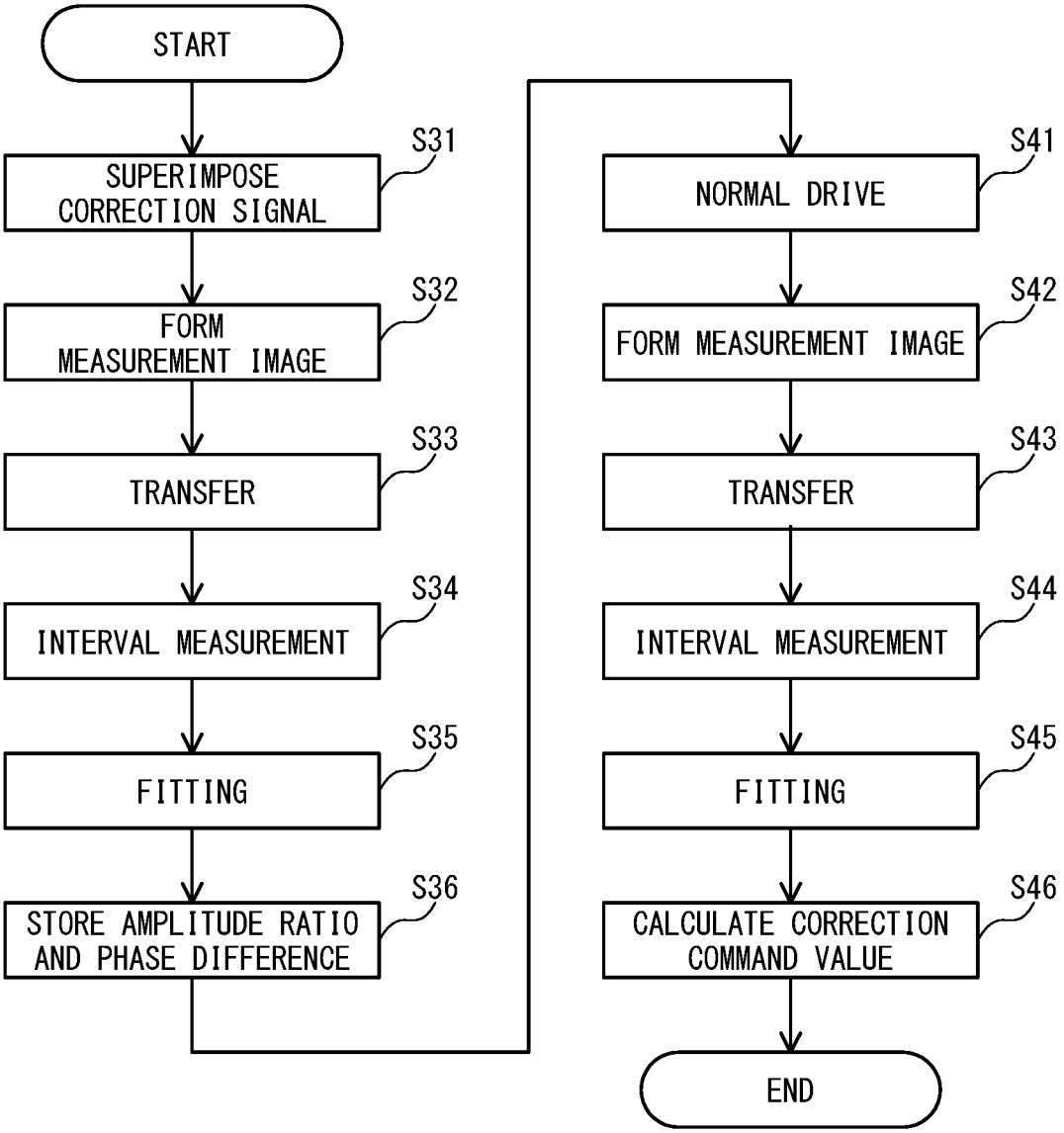
FIG. 11 is a flowchart showing the correction processing of the periodic unevenness.

FIG. 11 is a flowchart showing correction processing of the periodic unevenness of the photosensitive drum 10Y. The correction processing is performed after completion of the processing of the first phase and the second phase shown in FIG. 8. The correction processing is roughly divided into two phases. In a third phase, a response of the photosensitive drum 10Y as the drum drive control system is correlated with a reference position of one rotation of the photosensitive drum 10Y and the correction signal. In a fourth phase, the periodic unevenness of the photosensitive drum 10Y is corrected according to the actual measurement result of the measurement image. The fourth phase is executed after executing the third phase. The processing is performed by a main control system (described later).

The processing of the third phase will be described.

Simultaneously with the detection of the reference position by the drum HP sensor 12Y, the correction signal of the rotation speed of the photosensitive drum 10Y having the amplitude 10 times as much as the assumed amount of the periodic unevenness of the photosensitive drum 10Y to be corrected (ten-fold correction signal) is superimposed on the speed command value indicating the rotation speed of the photosensitive drum 10Y (Step S31). Since the periodic unevenness of the photosensitive drum 10Y is assumed to be approximately 0.1% with respect to the rotation speed of the photosensitive drum 10Y, the ten-fold correction signal becomes approximately 1% of the target speed. The correction signal is the primary sine wave and is represented by $C\sin\theta$ ($\theta=2\pi t/K$). When t=0, the drum HP sensor 12Y detects the reference position. $2\pi/K$ is the one rotation period of the photosensitive drum 10Y. At this time, the correction control processing for the photosensitive drum 10K as described above is always performed.

The measurement image for measuring the rotation period is formed on the photosensitive drum 10Y (Step S32). In the present embodiment, as in the case of the black measurement image shown in FIG. 9, in the measurement image, the patch image of 1 mm width is formed at 1 mm intervals in the length corresponding to two rotations of the photosensitive drum 10Y. In a case where the circumferential length of the photosensitive drum 10Y is 9 mm, the length of the measurement image is 192 mm. At this time, the measurement image illustrated in FIG. 9 is also formed on the photosensitive drum 10K. The measurement image to be formed on the photosensitive drum 10K and the measurement image to be formed on the photosensitive drum 10Y are formed at different positions in the longitudinal direction of the patch image forming the measurement image (direction orthogonal to the rotational direction of the intermediate transfer member 24). The measurement image to be formed on the photosensitive drum 10K is formed after the processing shown in FIG. 8, so that the measurement image is formed in a state in which the periodic unevenness of the photosensitive drum 10K is corrected.

The measurement image formed on the photosensitive drum 10Y and the measurement image formed on the photosensitive drum 10K are transferred to the intermediate transfer member 24 (Step S33). The interval between the patch images is measured on the basis of the reading result of the measurement image read from the intermediate transfer member 24 by the intermediate transfer member upper sensor 1004 (Step S34). At this time, the interval between the yellow patch images of the photosensitive drum 10Y is derived on the basis of the black patch image on the photosensitive drum 10K. This is because the periodic unevenness of the black patch image on the photosensitive drum 10K is corrected using the drum upper sensor 25. The positional deviation waveform on the surface (detection surface) of the photosensitive drum 10Y is calculated with respect to the interval between the yellow patch images of the photosensitive drum 10Y, and the fitting of $C'\sin(\theta+\gamma+\pi/2)$ to the primary trigonometric function is performed by the least squares method (Step S35). An amplitude ratio C'/C and a phase difference $\gamma$ are stored in a predetermined memory on the basis of the result of the fitting (Step S36).

As described above, the processing of the third phase is performed. The processing of the third phase is performed for the same purpose as the processing of the first phase, and differs from the processing of the first phase in that two factors are actually measured. A first factor is the same as that described in the first phase, and is the response of the drum drive control system of the photosensitive drum 10Y. A second factor is the same as that described in the first phase, in which the drum upper sensor 25 in the first phase is replaced by the intermediate transfer member upper sensor 1004.

Figure 12A:
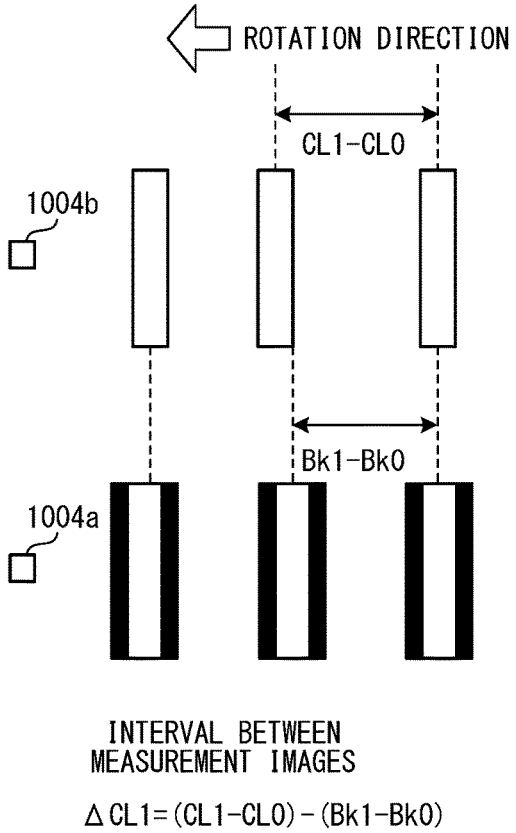
FIG. 12A and FIG. 12B are diagrams each explaining interval measurement between yellow patch images.
Figure 12B:
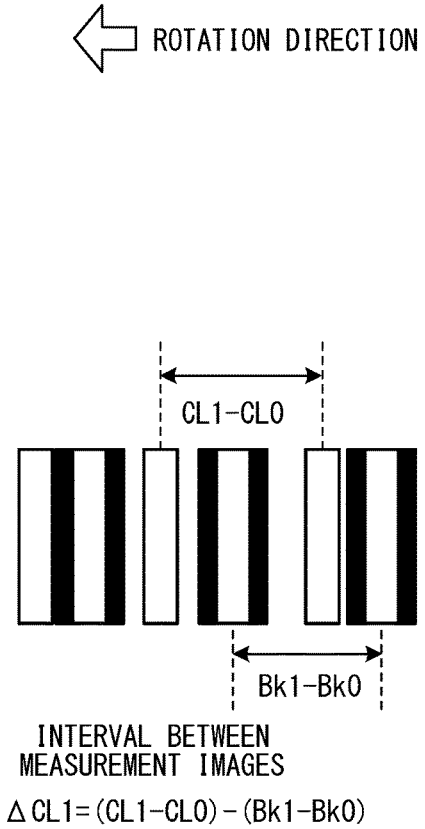

The third phase is different from the first phase in that the interval between the yellow patch images is derived on the basis of the black patch image. FIG. 12A and FIG. 12B are diagrams each explaining interval measurement between the yellow patch images. In FIG. 12A, an interval ΔCL1 of the yellow patch image is derived with reference to the position of the black patch image. That is, the interval ΔCL1 between the yellow patch images is calculated by a difference between a difference of the positions of the yellow patch images (CL1−CL0) and a difference between the positions of the black patch images (Bk1−Bk0). As described above, the black measurement image to be formed on the photosensitive drum 10K is not detected on the intermediate transfer member 24. Therefore, the position of the black measurement image is detected by the patch image in which the black image is overlapped with a part of the yellow image. Through the processing of the third phase, noise components such as a variation in the rotation speed of the intermediate transfer member 24 by the drive roller 29 and the unevenness in the thickness of the intermediate transfer member 24 are removed.

It is common to correct the inclination or the bend of the irradiation position on the image data by a digital correction technique. For this reason, a plurality of intermediate transfer member upper sensors 1004 are often used, and the measurement image on the photosensitive drum 10K and the measurement image on the photosensitive drum 10Y can be measured at the same timing as in the third phase. In the third phase of the present embodiment, two of the three intermediate transfer member upper sensors 1004*a*, 1004*b*, and 1004*c* are used to detect the measurement image. In FIG. 12A, the black measurement image is detected by the intermediate transfer member upper sensor 1004*a*, and the yellow measurement image is detected by the intermediate transfer member upper sensor 1004*b*. In a case where three or more intermediate transfer member upper sensors 1004 are used, the processing of the third phase can be performed on the photosensitive drum 10 of two or more chromatic colors.

In an image forming apparatus in which cost is regarded as most important, only one intermediate transfer member upper sensor 1004 may be provided. In this case, as shown in FIG. 12B, the yellow patch image and the black patch image are alternately formed on the intermediate transfer member 24. Thus, the interval between the yellow patch images is derived on the basis of the black patch image. Also, in this case, the interval ΔCL1 between the yellow patch images is calculated by the difference between the difference of the positions of the yellow patch images (CL1−CL0) and the difference of the positions of the black patch images (Bk1−Bk0).

Since the yellow measurement image (patch image) and the black measurement image (patch image) are alternately detected, a detection timing difference occurs according to the deviation of the position of each patch image. Therefore, the variation in the rotation speed of the intermediate transfer member 24 at the time of detection occurs as noise. It is also necessary to increase the interval between the yellow patch images on the photosensitive drum 10Y. This leads to a decrease in the number of samplings of the measurement image. However, since the interval between the patch images is not wide with respect to the noise components such as the variation in the rotation speed of the intermediate transfer member 24 by the drive roller 29 and the unevenness in the thickness of the intermediate transfer member 24, the influence of the detection timing difference according to the deviation of the position of each patch image is negligibly small. Therefore, processing with sufficient accuracy is possible.

The processing of the fourth phase will be described.

The photosensitive drum 10Y is rotationally driven at the specified target speed in accordance with the normal speed command value on which no correction signal is superimposed (Step S41). The measurement image is formed on the photosensitive drum 10Y (Step S42). At this time, the measurement image is formed on the photosensitive drum 10K as well. The measurement image to be formed on the photosensitive drum 10K and the measurement image to be formed on the photosensitive drum 10Y are formed at the different positions in the longitudinal direction of the patch image forming the measurement image (direction orthogonal to the rotational direction of the intermediate transfer member 24).

The measurement image formed on the photosensitive drum 10Y and the measurement image formed on the photosensitive drum 10K are transferred to the intermediate transfer member 24 (Step S43). The interval between the patch images is measured on the basis of the reading result of the measurement image read from the intermediate transfer member 24 by the intermediate transfer member upper sensor 1004 (Step S44). At this time, the interval between the yellow patch images of the photosensitive drum 10Y is derived on the basis of the black patch image of the photosensitive drum 10K. The positional deviation waveform on the surface (detection surface) of the photosensitive drum 10Y is calculated with respect to the interval between the yellow patch images of the photosensitive drum 10Y, and the fitting of D' $\sin(\theta+\delta+\pi/2)$ to the primary trigonometric function is performed by the least squares method (Step S45). The command value for correcting the periodic unevenness of the photosensitive drum 10Y is calculated by the following equation on the basis of the result of the fitting (Step S46).

When the correction equation is Y $\sin(\theta+t)$, $$Y=(C\times D)/C'$$

$$t=\delta-\gamma$$

Through the above processing, the correction term for correcting the periodic unevenness of the photosensitive drum 10Y is determined. By superimposing the command value of the sine wave calculated in the processing of the Step S46 on the speed command value for controlling the rotation speed of the photosensitive drum 10Y, the periodic unevenness is corrected. In a case where the speed command value after the correction is V and the speed command value before the correction is Vcl, the speed command value V is expressed by the following equation.

$$V=Vcl+Y\sin(\theta+t)$$

The processing of the third phase and the processing of the fourth phase are repeatedly performed by the number of the photosensitive drums 10 of the chromatic color. As described above, in a case where three or more intermediate transfer member upper sensors 1004 are provided, the processing of the third phase and the processing of the fourth phase can be performed simultaneously for a plurality of photosensitive drums 10. In this case, the number of processings can be reduced.

By performing the processing of the first to fourth phases as described above, the speed command value for correcting the periodic unevenness of all the photosensitive drums 10 is generated. When the correction control processing is actually performed, the speed command value to be input to the driving unit for driving the photosensitive drums 10 may be calculated from the above equation each time. Instead, a correction table may be used and the speed command value may be read from the correction table.

Figure 13A:
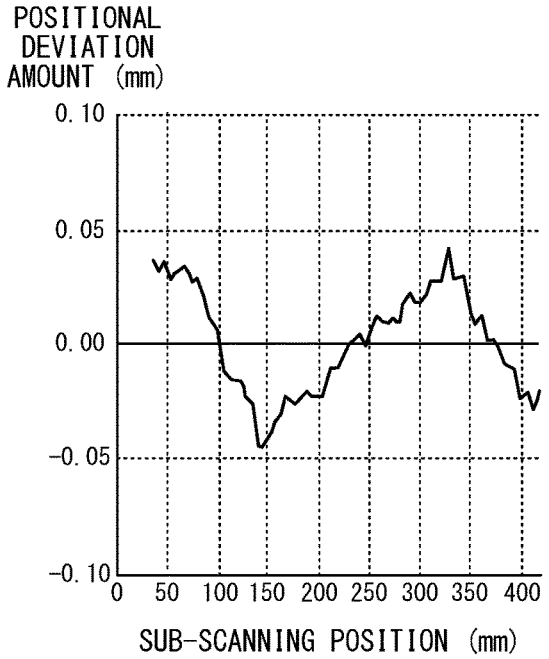
FIG. 13A and FIG. 13B are diagrams each explaining a result after correcting the periodic unevenness.
Figure 13B:
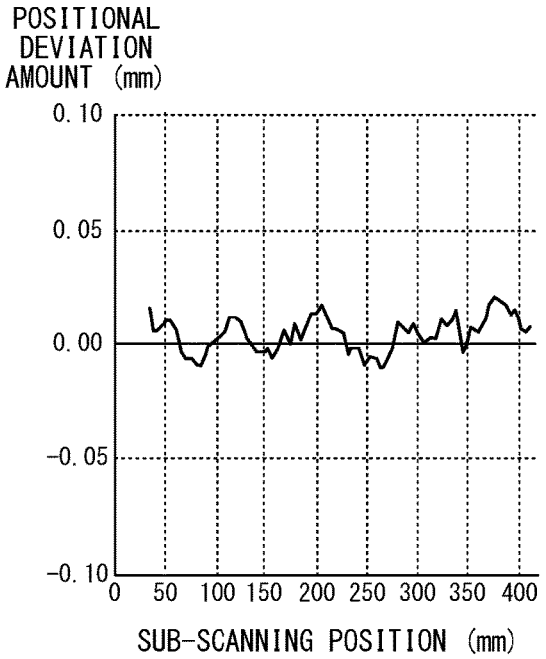
Figure 14A:
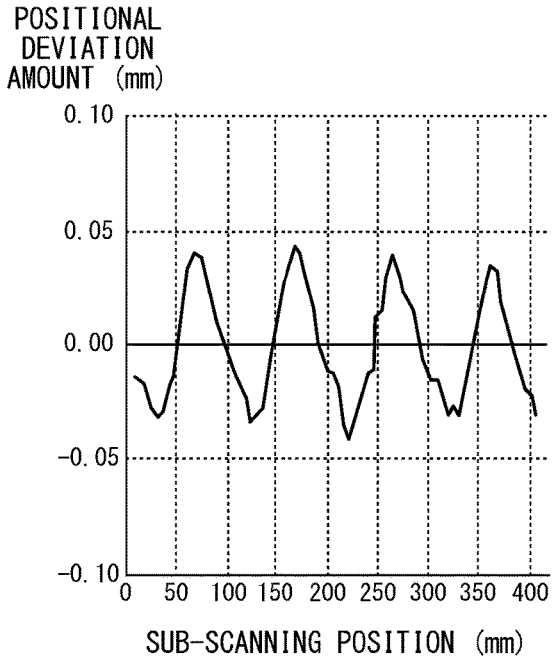
FIG. 14A and FIG. 14B are diagrams each explaining a result after correcting the periodic unevenness.
Figure 14B:
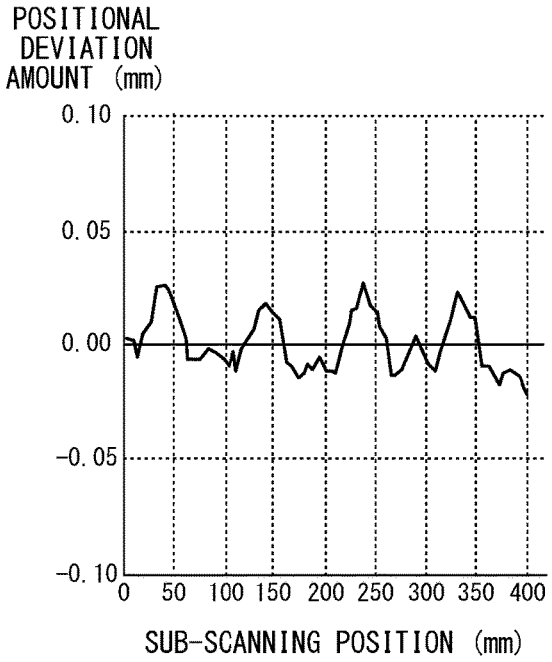

FIG. 13A, FIG. 13B, FIG. 14A and FIG. 14B are diagrams each explaining a result after correcting the periodic unevenness by the processing of the first to fourth phases. FIG. 13A and FIG. 13B show the correction results of the photosensitive drum 10K for forming the black image. FIG. 14A and FIG. 14B show the correction results of the photosensitive drum 10Y for forming the yellow image. FIG. 13A and FIG. 14A show a deviation amount of the image forming position before the correction. FIG. 13B and FIG. 14B show the deviation amount of the image forming position after the correction. In the figure, a sub-scanning position indicates the position of the photosensitive drum 10 in the rotation direction. The photosensitive drum 10 is scanned with the laser beam in an axial direction of the drum by the exposure device 22. Therefore, the axial direction of the drum is a main scanning direction, and a direction orthogonal to the main scanning direction is the sub-scanning direction. It should be noted that, in FIG. 4, FIG. 5A and FIG. 5B, the X-axis direction is the same as the main scanning direction, and the Y-axis direction is the same as the sub-scanning direction. By comparing FIG. 13A and FIG. 14A with FIG. 13B and FIG. 14B, it can be found that the periodic unevenness is suppressed and the positional deviation amount for each sub-scanning position is reduced.

Fitting by Least Squares Method

The fitting processing to the primary sine wave performed in the processing of the Steps S14, S24, S35 and S45 in the first to fourth phases will be described. In the present embodiment, the fitting processing to the primary sine wave is performed by an algorithm based on a theory of the least squares method. In general, a primary sine wave y(x) can be expressed as follows.

$$y(x)=A\sin x+B\cos x+C$$

In the present embodiment, the positional deviation amount at the detection position x mm of the patch image of the measurement image is y (x) μm. Further, to sample the patch image of 1 mm width every 1 mm, a sampling period Tspl is set to 2 mm. At this time, since the circumferential length of the photosensitive drum 10Y is 96 mm, the sine wave y (x) has a sine wave shape of TApt=96 mm. An ideal positional deviation amount is expressed by the following equation.

$$\hat{y}(x) = A\sin\left(\frac{2\pi}{T_{Apt}}x\right) + B\cos\left(\frac{2\pi}{T_{Apt}}x\right) + C \quad \text{[Mathematical 1]}$$

When the total number of the detected patch images of the measurement image is N, A, B, and C which minimize an error e(A, B, C) are calculated by the least squares method as shown in the following equation.

$$e(A, B, C) = \sum_{k=1}^{N} (y(kT_{Spl}) - \hat{y}(kT_{Spl}))^2 \quad \text{[Mathematical 2]}$$

This equation can be solved by following simultaneous equations, where A, B, and C are algebraically unknown.

$$\left\{\sum_{k=1}^{N} \sin^2\left(\frac{2\pi}{T_{Apt}}kT_{Spl}\right)\right\}A + \left\{\sum_{k=1}^{N} \sin\left(\frac{2\pi}{T_{Apt}}kT_{Spl}\right)\cos\left(\frac{2\pi}{T_{Apt}}kT_{Spl}\right)\right\}B + \left\{\sum_{k=1}^{N} \sin\left(\frac{2\pi}{T_{Apt}}kT_{Spl}\right)\right\}C = \sum_{k=1}^{N} y(kT_{Spl})\sin\left(\frac{2\pi}{T_{Apt}}x\right) \quad \text{[Mathematical 3]}$$

$$\left\{\sum_{k=1}^{N} \sin\left(\frac{2\pi}{T_{Apt}}kT_{Spl}\right)\cos\left(\frac{2\pi}{T_{Apt}}kT_{Spl}\right)\right\}A + \left\{\sum_{k=1}^{N} \cos^2\left(\frac{2\pi}{T_{Apt}}kT_{Spl}\right)\right\}B + \left\{\sum_{k=1}^{N} \cos\left(\frac{2\pi}{T_{Apt}}kT_{Spl}\right)\right\}C = \sum_{k=1}^{N} y(kT_{Spl})\cos\left(\frac{2\pi}{T_{Apt}}x\right)$$

$$\left\{\sum_{k=1}^{N} \sin\left(\frac{2\pi}{T_{Apt}}kT_{Spl}\right)\right\}A + \left\{\sum_{k=1}^{N} \cos\left(\frac{2\pi}{T_{Apt}}kT_{Spl}\right)\right\}B + \left\{\sum_{k=1}^{N} 1\right\}C = \sum_{k=1}^{N} y(kT_{Spl})$$

Figure 15:
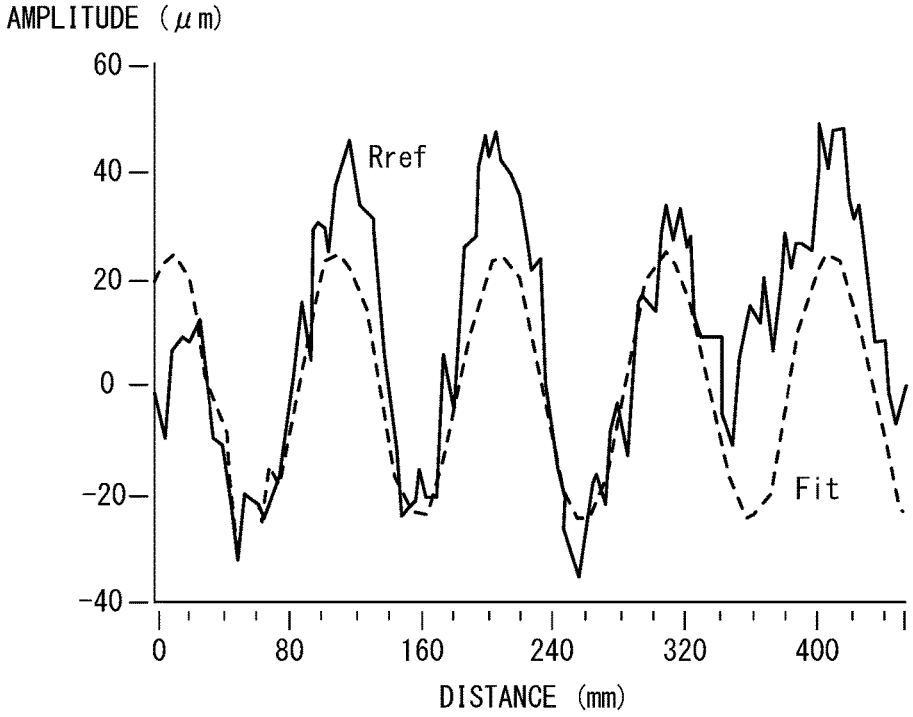
FIG. 15 is a diagram explaining a result of a fitting.

Therefore, the calculation of the misregistration correction amount using the least squares method is nothing more than an act of deriving A and B from the simultaneous equations described above, and is finally a simple matrix operation. FIG. 15 is a diagram explaining the result of the fitting by the least squares method. A waveform Rref of the detected patch image is represented by a solid line, and a fitted waveform Fit is represented by a broken line. A distance on a horizontal axis is a distance from the reference position in the rotation direction of the photosensitive drum 10.

Main Control System

Figure 16:
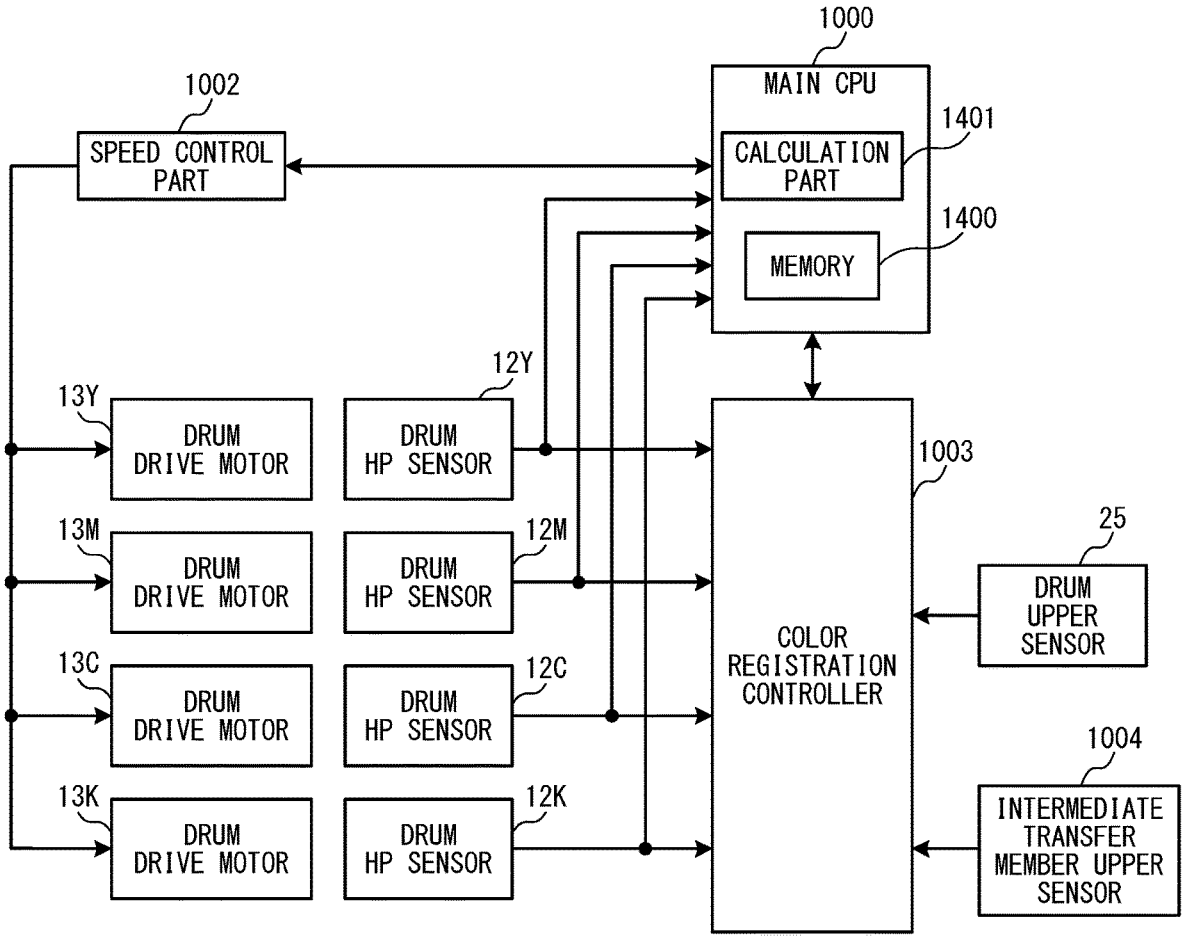
FIG. 16 is a diagram explaining a main control system.

FIG. 16 is an explanatory diagram of a main control system of the image forming apparatus for performing such processing. The main control system is incorporated in the image forming apparatus. In the image forming apparatus, operation of each part is controlled by the main control system to perform the image forming processing. The main control system shows a configuration for performing the above processing.

The main control system of the present embodiment includes a main CPU (Central Processing Unit) 1000, a speed control part 1002, and a color registration controller 1003. The main CPU 1000 includes a calculation part 1401 and a memory 1400. The main CPU 1000 controls entire operation of the image forming apparatus by performing a predetermined computer program. The main CPU 1000 is connected to the color registration controller 1003 and the speed control part 1002, and performs the above processing in cooperation with each other.

The color registration controller 1003 obtains the detection results from the drum upper sensor 25, the intermediate transfer member upper sensor 1004, and the drum HP sensors 12Y, 12M, 12C, and 12K. It should be noted that the detection results of the drum HP sensors 12Y, 12M, 12C, and 12K are also input to the main CPU 1000.

The speed control part 1002 is connected to the drum drive motors 13Y. 13M, 13C, and 13K. The speed control part 1002 drives and controls the drum drive motors 13Y, 13M, 13C, and 13K according to an instruction from the main CPU 1000. When the drum drive motor 13 rotates, the drum HP sensor 12 detects the phase of one rotation of the photosensitive drum 10.

With such a configuration, the color registration controller 1003 detects the interval between the patch images with high accuracy from the detection result of each sensor by a built-in high-speed clock counter. The color registration controller 1003 counts the interval between the patch images of the measurement image with high accuracy by the high-speed clock counter on the basis of the detection result of the intermediate transfer member upper sensor 1004. The color registration controller 1003 counts the interval between the patch images of the measurement image formed on the photosensitive drum 10K with high accuracy by the high-speed clock counter on the basis of the detection result of the drum upper sensor 25. At the same time, the color registration controller 1003 accurately matches phase information on the basis of the detection result of the drum HP sensor 12. The color registration controller 1003 inputs a count result to the main CPU 1000. The color registration controller 1003 performs the interval measurement processing (Steps S13, S23, S2, S3, S2) of the first to fourth phase.

The main CPU 1000 performs light emission control of the exposure device 22 on the basis of the detection result of the interval between the patch images by the color registration controller 1003 to correct the image writing position on the photosensitive drum 10. The main CPU 1000 performs the calculation including the least squares method on the count result obtained from the color registration controller 1003 by the calculation part 1401 to extract an amplitude value and the phase difference. A calculation result by the calculation part 1401 is stored in the memory 1400. The main CPU 1000 generates the speed command value indicating the rotation speed of the photosensitive drum 10 and the intermediate transfer member 24 on the basis of the information stored in the memory 1400, and transmits the speed command value to the speed control part 1002. The main CPU 1000 obtains the reference position of one rotation of the photosensitive drum 10 from the detection result of the drum HP sensor 12. The main CPU 1000 resets the speed command value on the basis of the obtained one rotation of the photosensitive drum 10. The speed control part 1002 controls the rotation speed of the photosensitive drum 10 according to the speed command value obtained from the main CPU 1000. The main CPU 1000 performs processing other than the processing of the first to fourth phases.

It should be noted that at the time of the auto registration, the color registration controller 1003 obtains the detection result of the detection image from the intermediate transfer member upper sensor 1004 to detect the misregistration amount. The main CPU 1000 performs the light emission control of the exposure device 22 according to the misregistration amount to correct the misregistration.

First Modification

In the above description, the periodic unevenness of the photosensitive drum 10 is corrected by actually measuring the response of the drum drive control system in the first phase and the third phase, and driving and controlling the photosensitive drum 10 according to the actual measurement results. By the way, to improve productivity, one rotation period of the photosensitive drum 10 tends to be shorter. This makes it difficult to follow the drive control by the drum drive control system. Further, the drum drive control system itself may be simplified, and the driving source for the photosensitive drum 10 may be integrated. In these cases, it is difficult to correct the periodic unevenness by the drive control of the photosensitive drum 10. Therefore, in a first modification, the periodic unevenness is corrected by correcting the image data. Two specific examples will be described.

A first example is the correction using the exposure device 22. Conventionally, a configuration in which the exposure device 22 scans the photosensitive drum 10 with the laser beam in the main scanning direction to form the electrostatic latent image has been known. An LED (Light Emitting Diode) array in which a plurality of light emitting elements are arranged in the main scanning direction may be used as a laser unit which is the light source of the laser beam. In a case where the LED array is used, the exposure device 22 does not need to scan the laser beam, and the photosensitive drum 10 can be irradiated with the laser beam by lighting each light emitting element at predetermined timing.

The lighting timing of each light emitting element can be changed. Therefore, by controlling the lighting timing according to the image data, the image of a periodic pattern can be formed. That is, it becomes unnecessary to consider the response of the drum drive control system in the first phase and the third phase. Therefore, it is possible to correct the periodic unevenness if only a geometrical arrangement, which is the second factor as mentioned, is considered. If the geometric arrangement is only a matter to be considered, if it is acceptable to include an error in component accuracy, by calculating the correction value in advance and by correcting the image data by the correction value to perform the correction control, time required for the correction control can be shortened.

Further, since the LED array is provided corresponding to each photosensitive drum 10, the lighting timing of the LED array can be controlled for each photosensitive drum 10. With such a configuration, even in the drum drive control system in which all the photosensitive drums 10 are driven by one driving source, it is possible to correct the periodic unevenness with each photosensitive drum 10.

In a second example, the periodic unevenness is suppressed by correcting the image data according to the periodic unevenness. Specifically, this is realized by partially altering density of the image, similar to a principle of changing a magnification in the sub-scanning direction. That is, a center of gravity of the image is moved so as to cancel the periodic unevenness.

The first modification in which the periodic unevenness is corrected by correcting the image data may be performed in combination with the above-described processing in which the periodic unevenness is corrected by the drum drive control system.

Main Control System

Figure 17:
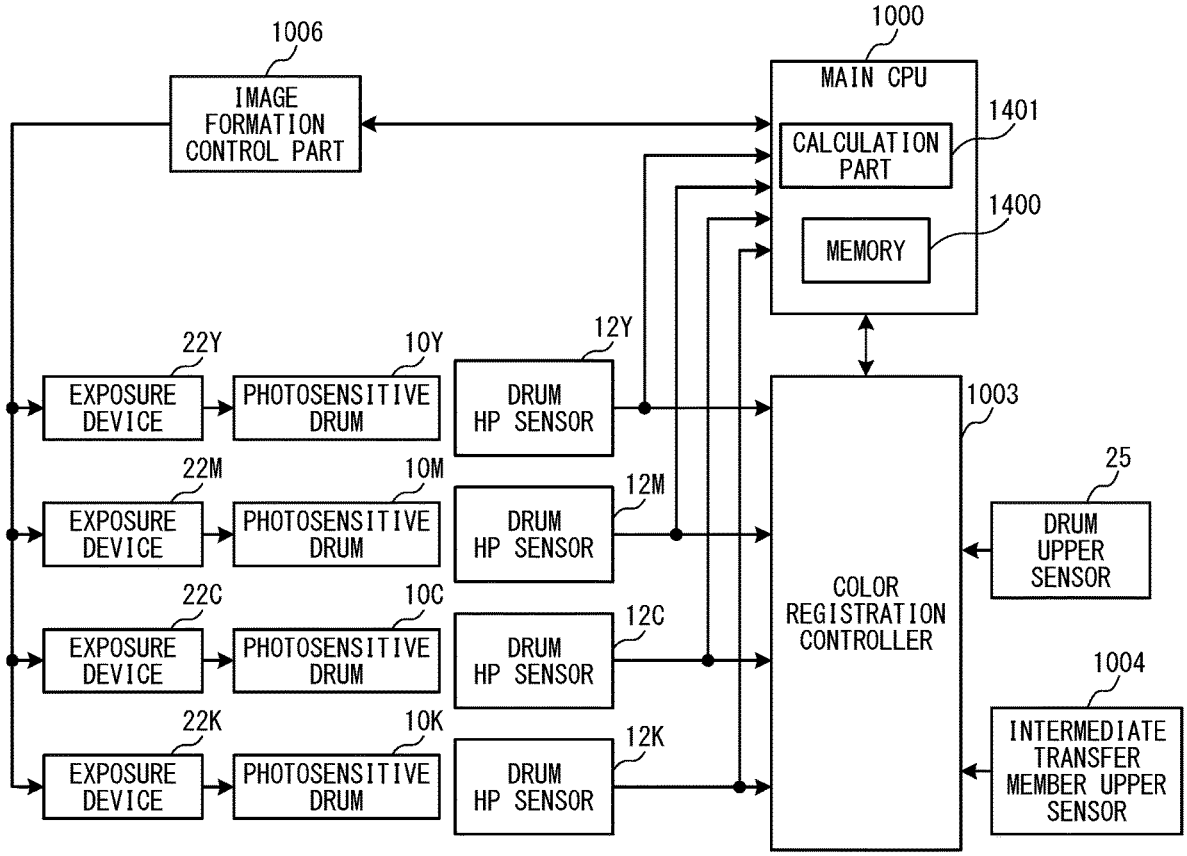
FIG. 17 is a diagram explaining the main control system.

FIG. 17 is an explanatory diagram of the main control system of the image forming apparatus for performing the processing of the first modification. The main control system includes the main CPU 1000 and the color registration controller 1003, similar to the main control system shown in FIG. 16. The color registration controller 1003 obtains the detection results of the drum upper sensor 25, the intermediate transfer member upper sensor 1004, and the drum HP sensor 12, and performs the same processing as the color registration controller 1003 shown in FIG. 16.

The main CPU 1000 is connected to an image formation control part 1006. The main CPU 1000 obtains the interval between the patch images of the measurement image from the color registration controller 1003 and calculates the correction value. The main CPU 1000 transmits the correction value to the image formation control part 1006. The image formation control part 1006 corrects the image data representing the image to be formed according to the correction value. The image data is prepared for each color of the image to be formed. Therefore, the image formation control part 1006 corrects the image data corresponding to the color according to the correction value corresponding to the color. The image formation control part 1006 controls the lighting timing of each exposure device 22 according to the corrected image data to perform the image formation on the photosensitive drum 10. As a result, the image in which the periodic unevenness is corrected is formed.

In addition, the periodic unevenness may be corrected by a configuration in which the configuration shown in FIG. 16 and the configuration shown in FIG. 17 are combined. For example, the correction of the periodic unevenness of the photosensitive drum 10K is performed by actually measuring the response of the drum drive control system in the first phase and the third phase, and the correction of the periodic unevenness of the other photosensitive drums 10Y, 10M, and 10C is performed by correcting the image data. As described above, the photosensitive drum 10K of the image forming part 200K for forming the monochrome image has the larger drum diameter than the other photosensitive drums 10Y, 10M, and 10C. Thus, the photosensitive drum 10K may have a size capable of actually measuring the response of the drum drive control system to correct the period unevenness. In such a case, the configuration in which the configuration shown in FIG. 16 and the configuration shown in FIG. 17 are combined is effective.

Second Modification

In a second modification, after correcting the periodic unevenness of the photosensitive drum 10, the periodic unevenness due to the rotation of the drive roller 29 of the intermediate transfer member 24 is corrected. The image forming apparatus is configured such that the distance by which the intermediate transfer member 24 is conveyed by one rotation of the drive roller 29 is an integer multiple of the arrangement interval between each of the photosensitive drums 10. In such a configuration, even when the periodic unevenness of the drive roller 29 is largely generated, no misregistration occurs.

However, one rotation period of the drive roller 29 causes the large noise when reading the detection image or the measurement image on the intermediate transfer member 24. Since it is mainly influenced when the automatic registration is performed, the detection image for the auto registration is repeatedly formed until the influence of the periodic unevenness of the drive roller 29, the photosensitive drums 10Y, 10M, and 10C, and the photosensitive drum 10K is minimized. It means that, by correcting the periodic unevenness of the drive roller 29, the number of times of forming the detection image for the auto registration can be reduced.

Main Control System

Figure 18:
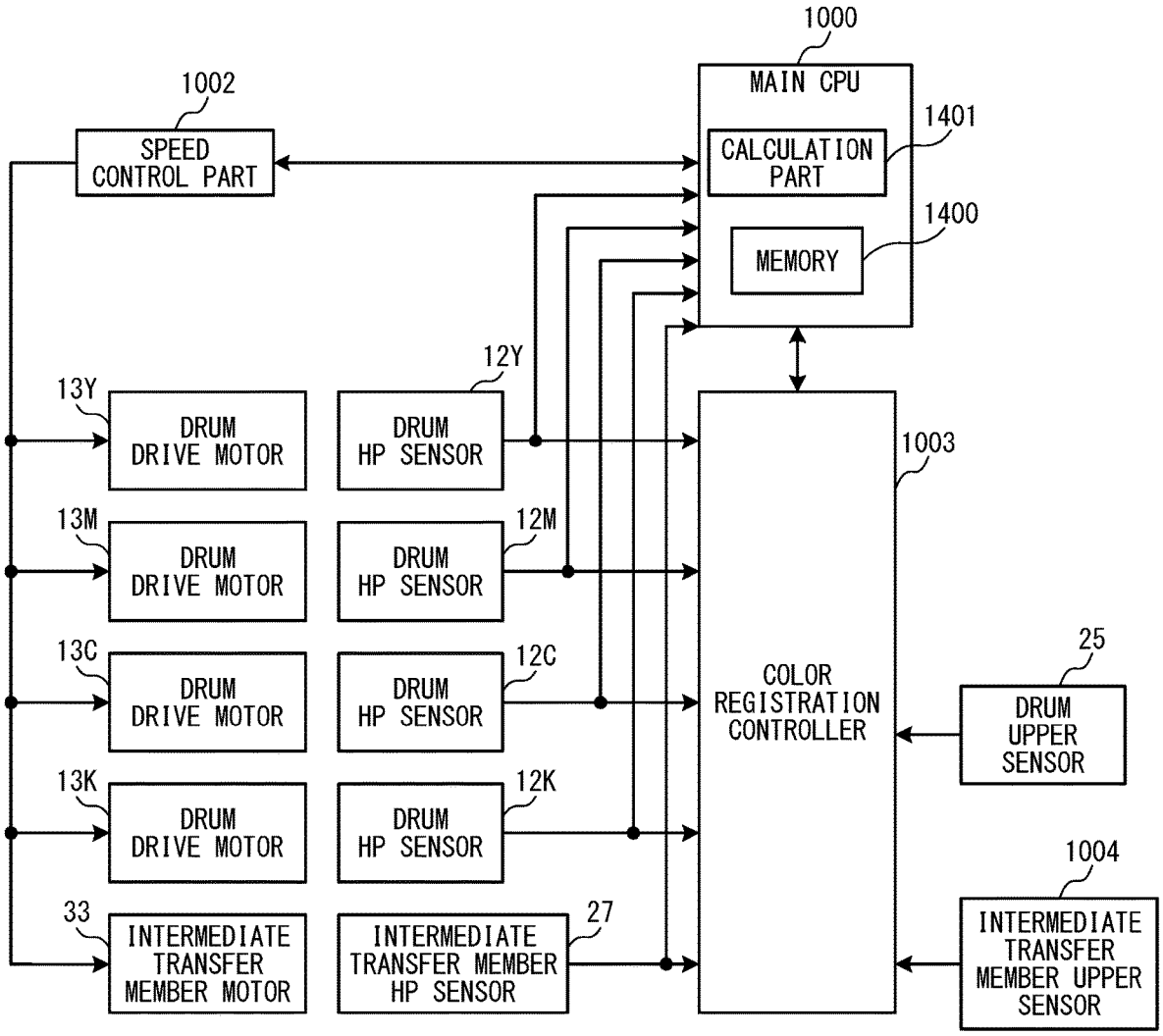
FIG. 18 is a diagram explaining the main control system.

FIG. 18 is an explanatory diagram of the main control system of the image forming apparatus for performing the processing of the second modification. The main control system is configured by adding an intermediate transfer member motor 33 and an intermediate transfer member HP sensor 27 to the configuration shown in FIG. 16. Different configurations will be described.

The speed control part 1002 is connected to the intermediate transfer member motor 33 in addition to the drum drive motors 13Y, 13M, 13C, and 13K. The intermediate transfer member motor 33 is the driving source for rotating the intermediate transfer member 24 by rotationally driving the drive roller 29. The speed control part 1002 drives and controls the intermediate transfer member motor 33 according to the instruction from the main CPU 1000. When the intermediate transfer member motor 33 rotates, the intermediate transfer member HP sensor 27 detects the phase of one rotation of the intermediate transfer member 24.

Figure 19:
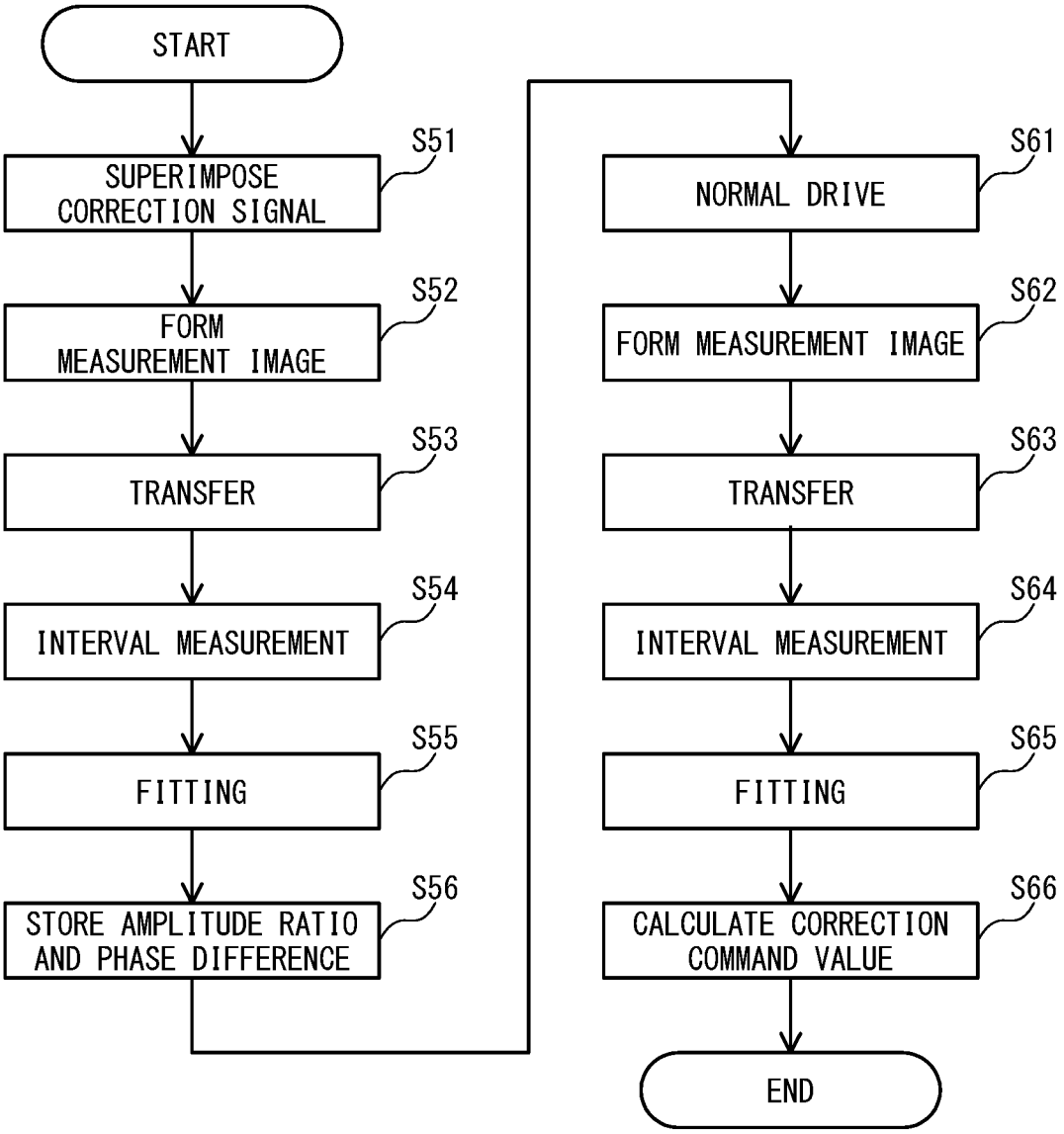
FIG. 19 is a flowchart showing the correction processing of the periodic unevenness.

FIG. 19 is a flowchart showing the correction processing of the periodic unevenness of the drive roller 29. The correction processing is roughly divided into 2 phases. In a fifth phase, a response of the drive roller 29 as an intermediate transfer member drive control system is correlated by a reference position of one rotation of the intermediate transfer member 24 and the correction signal. Ina sixth phase, the periodic unevenness of the drive roller 29 is corrected according to the actual measurement result of the measurement image. The sixth phase is executed after executing the fifth phase.

The processing of the fifth phase will be described. Simultaneously with detection of the reference position by the intermediate transfer member HP sensor 27, the correction signal of the rotation speed of the intermediate transfer member 24 having the amplitude 10 times as much as the assumed amount of the periodic unevenness of the drive roller 29 to be corrected is superimposed on the speed command value indicating the rotation speed of the intermediate transfer member 24 (Step S51). The correction signal is the primary sine wave and is represented by E sin θ ($\theta=2\pi t/J$). When t=0, the intermediate transfer member HP sensor 27 detects the reference position. $2\pi/J$ is one rotation period of the drive roller 29. At this time, the above-described correction control processing for the photosensitive drum 10K is always performed.

The measurement image for measuring the period is formed on the photosensitive drum 10K (Step S52). In the present embodiment, the measurement image is the same as shown in FIG. 9, i.e., the patch image of 1 mm width is formed at 1 mm intervals in the length corresponding to two rotations of the drive roller 29. In a case where the circumferential length of the drive roller 29 is 120 mm, the length of the measurement image is 240 mm.

The measurement image formed on the photosensitive drum 10K is transferred to the intermediate transfer member 24 (Step S53). The interval between the patch images is measured on the basis of the reading result of the measurement image read from the intermediate transfer member 24 by the intermediate transfer member upper sensor 1004 (Step S54). The positional deviation waveform on the surface (detection surface) of the intermediate transfer member 24 is calculated with respect to the interval between the patch images, and the fitting of $E' \sin(\theta+\varepsilon+\pi/2)$ to the primary trigonometric function is performed by the least squares method (Step S55). An amplitude ratio E'/E and a phase difference ε are stored in a predetermined memory on the basis of the result of the fitting (Step S56).

As described above, the processing of the fifth phase is performed. The processing of the fifth phase is performed for the same purpose as the processing of the first phase and the third phase. Although the measurement image is formed on the photosensitive drum 10K in the above example, other photosensitive drums 10Y, 10M, and 10C may be used as long as the periodic unevenness is corrected. However, since the other photosensitive drums 10Y, 10M, and 10C are corrected on the basis of the photosensitive drum 10K, the periodic unevenness is corrected including the error related to the image formation of the photosensitive drum 10K. Since only the noise of the photosensitive drum 10K itself becomes an error factor, it is desirable that the measurement image is formed on the photosensitive drum 10K. By detecting the measurement image by the intermediate transfer member upper sensor 1004 from the intermediate transfer member 24, the unevenness related to the intermediate transfer member 24 such as the periodic unevenness of the drive roller 29 and the unevenness in the thickness of the intermediate transfer member 24, which are the noises in the second and fourth phases, are detected.

The processing of the sixth phase will be described. The intermediate transfer member 24 is rotationally driven at the specified target speed according to the normal speed command value on which no correction signal is superimposed (Step S61). The measurement image is formed on the photosensitive drum 10K (Step S62). The measurement image formed on the photosensitive drum 10K is transferred to the intermediate transfer member 24 (Step S63). The interval between the patch images is measured on the basis of the reading result of the measurement image read from the intermediate transfer member 24 by the intermediate transfer member upper sensor 1004 (Step S64). The positional deviation waveform on the surface (detection surface) of the intermediate transfer member 24 is calculated with respect to the interval between the measured patch images, and the fitting of F' $\sin(\theta+\zeta+\pi/2)$ to the primary trigonometric function is performed by the least squares method (Step S65). The command value for correcting the periodic unevenness of the drive roller 29 of the intermediate transfer member 24 is calculated by the following equation on the basis of the result of the fitting (Step S66).

When the correction equation is $Z \sin(\theta+\lambda)$, $$Z=(E\times F)/E'$$

$$\lambda=\zeta-\varepsilon$$

Through the above processing, the correction term for correcting the periodic unevenness of the drive roller 29 of the intermediate transfer member 24 is determined. By superimposing the command value of the sine wave calculated in the processing of the Step S66 on the speed command value for controlling the rotation speed of the intermediate transfer member 24, the periodic unevenness is corrected. In a case where the speed command value after the correction is V and the speed command value before the correction is Vitb, the speed command value V is expressed by the following equation.

$$V=Vitb+Z\sin(\theta+\lambda)$$

The processing may be performed simultaneously with the processing of the third phase and the fourth phase. The correction time is reduced by performing the processing simultaneously with the processing of the third phase and the fourth phase. Further, the processing may be performed in combination with the processing of the first modification.

According to the present embodiment as described above, the periodic unevenness of the photosensitive drum 10 and the periodic unevenness of the intermediate transfer member 24 are corrected. The position of each of the patch images 301 to 304 of the detection image can be detected with high accuracy by performing the auto registration by correcting the periodic unevenness. Thus, the image forming apparatus of the present embodiment can provide a high-quality image while suppressing the deterioration of the image quality due to the misregistration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-078336, filed Apr. 17, 2019, which is hereby incorporated by reference herein in its entirety.

What is claimed is:

1. An image forming apparatus comprising:

a first image forming unit having a first photoreceptor and configured to form a first image on the first photoreceptor by using a first color toner;

a second image forming unit having a second photoreceptor and configured to form a second image on the second photoreceptor by using a second color toner which is different from the first color toner;

an intermediate transfer member configured to rotate in a predetermined direction and to which the first image and the second image are transferred;

a transfer unit configured to transfer the first image and the second image from the intermediate transfer member to a sheet;

a first sensor configured to measure measurement images on the first photoreceptor;

a second sensor configured to measure measurement images on the intermediate transfer member; and a controller configured to:

control the first image forming unit to form first measurement images, wherein the first measurement images are formed along a rotation direction of the first photoreceptor;

control the first sensor to measure the first measurement images on the first photoreceptor;

control the first image forming unit and the second image forming unit to form a plurality of measurement images while a rotation speed of the first photoreceptor is being controlled based on measurement results of the first measurement images by the first sensor, wherein the plurality of measurement images are formed along the predetermined direction of the intermediate transfer member, wherein the plurality of measurement images include reference measurement images formed by using the first color toner and second measurement images formed by using the second color toner, wherein positions at which the second measurement images are transferred on the intermediate transfer member are different from positions at which the reference measurement images are transferred on the intermediate transfer member in a direction orthogonal to the predetermined direction;

control the second sensor to measure the plurality of measurement images;

control a rotation speed of the second photoreceptor based on measurement results of the plurality of measurement images by the second sensors;

control the first image forming unit to form third measurement images while the rotation speed of the first photoreceptor is being controlled based on the measurement results of the first measurement images by the first sensor, wherein the third measurement images are formed along the predetermined direction of the intermediate transfer member;

control the second sensor to measure the third measurement images; and control a rotation speed of the intermediate transfer member based on measurement results of the third measurement images by the second sensor.

2. The image forming apparatus according to claim 1, wherein the second sensor includes a light receiving element that receives reflected light from the reference measurement images, and another light receiving element that receives reflected light from the second measurement images.

3. The image forming apparatus according to claim 1, wherein the controller is further configured to:

control the second sensor to measure an interval between the reference measurement images;

control the second sensor to measure an interval between the second measurement images; and control the rotation speed of the second photoreceptor based on the interval between the reference measurement images and the interval between the second measurement images.

4. The image forming apparatus according to claim 1, wherein the controller is further configured to:

control the rotation speed of the first photoreceptor based on a first rotation control signal;

control the first image forming unit to form other first measurement images while the rotation speed of the first photoreceptor is being controlled based on the first rotation control signal, wherein the other first measurement images are formed along the rotation direction of the first photoreceptor;

control the first sensor to measure the other first measurement images on the first photoreceptor; and control the rotation speed of the first photoreceptor based on a measurement result of the first measurement images and a measurement result of the other first measurement images.

5. The image forming apparatus according to claim 1, wherein the controller is further configured to:

control the rotation speed of the second photoreceptor based on a second rotation control signal;

control the first image forming unit and the second image forming unit to form another plurality of measurement images while the rotation speed of the first photoreceptor is being controlled based on the measurement result of the first sensor and the rotation speed of the second photoreceptor is being controlled based on the second rotation control signal, wherein the other plurality of measurement images are formed along the predetermined direction of the intermediate transfer member;

control the second sensor to measure the other plurality of measurement images; and control the rotation speed of the second photoreceptor based on a measurement result of the plurality of measurement images and a measurement result of the other plurality of measurement images.

6. The image forming apparatus according to claim 1, wherein the first color toner is black toner.

7. The image forming apparatus according to claim 1, wherein the second measurement images are transferred onto the intermediate transfer member such that the positions at which the second measurement images are transferred on the intermediate transfer member overlap with the positions at which the reference measurement images are transferred onto the intermediate transfer member in the predetermined direction.

8. An image forming apparatus comprising:

a first image forming unit having a first photoreceptor and configured to form a first image on the first photoreceptor by using a first color toner;

a second image forming unit having a second photoreceptor and configured to form a second image on the second photoreceptor by using a second color toner which is different from the first color toner;

an intermediate transfer member configured to rotate in a predetermined direction and to which the first image and the second image are transferred;

a transfer unit configured to transfer the first image and the second image from the intermediate transfer member to a sheet;

a first sensor configured to measure measurement images on the first photoreceptor;

a second sensor configured to measure measurement images on the intermediate transfer member; and a controller configured to:

control the first image forming unit to form first measurement images on the first photoreceptor, the first measurement images being formed in a rotation direction of the first photoreceptor;

control the first sensor to measure the first measurement images;

control the first image forming unit to form second measurement images on the first photoreceptor, the second measurement images being formed in the rotation direction of the first photoreceptor, wherein the second measurement images are transferred to the intermediate transfer member;

control the second image forming unit to form third measurement images on the second photoreceptor, the third measurement images being formed in a rotation direction of the second photoreceptor, wherein the third measurement images are transferred to the intermediate transfer member;

control the second sensor to measure the second measurement images and the third measurement images;

control a magnification of a first image to be formed by the first image forming unit in the rotation direction of the first photoreceptor based on measurement results of the first measurement images by the first sensor; and control a magnification of a second image to be formed by the second image forming unit in the rotation direction of the second photoreceptor based on measurement results of the second measurement images and the third measurement images by the second sensor.

9. The image forming apparatus according to claim 8, wherein the first image forming unit has a first light source that irradiates the first photoreceptor with a laser beam to form an electrostatic latent image for the first image, wherein the second image forming unit has a second light source that irradiates the second photoreceptor with a laser beam to form an electrostatic latent image for the second image, wherein the controller controls a timing at which the first light source irradiates the laser beam based on the measurement results of the first measurement images by the first sensor to control the magnification of a first image to be formed by the first image forming unit in the rotation direction of the first photoreceptor, and wherein the controller controls a timing at which the second light source irradiates the laser beam based on the measurement results of the second measurement images and the third measurement images by the second sensor to control the magnification of a second image to be formed by the second image forming unit in the rotation direction of the second photoreceptor.

10. The image forming apparatus according to claim 9, wherein the first light source is an LED array, and wherein the second light source is another LED array.

11. The image forming apparatus according to claim 9, further comprising a motor, wherein the first photoreceptor and the second photoreceptor are rotated by the motor.

12. The image forming apparatus according to claim 8, wherein the first image forming unit has a first light source that irradiates the first photoreceptor with a laser beam based on image data to form an electrostatic latent image for the first image, wherein the second image forming unit has a second light source that irradiates the second photoreceptor with a laser beam based on image data to form an electrostatic latent image for the second image, wherein the controller corrects the image data for the first image based on the measurement results of the first measurement images by the first sensor to control the magnification of a first image to be formed by the first image forming unit in the rotation direction of the first photoreceptor, and wherein the controller corrects the image data for the second image based on the measurement results of the second measurement images and the third measurement images by the second sensor to control the magnification of a second image to be formed by the second image forming unit in the rotation direction of the second photoreceptor.

13. The image forming apparatus according to claim 12, further comprising a motor, wherein the first photoreceptor and the second photoreceptor are rotated by the motor.

14. The image forming apparatus according to claim 8, further comprising a motor, wherein the first photoreceptor and the second photoreceptor are rotated by the motor.

15. The image forming apparatus according to claim 8, wherein the first color toner is black toner, and wherein the second color toner is yellow toner.

* * * * *